US005112042A

United States Patent [19]

Tilles et al.

[11] Patent Number: 5,112,042

[45] Date of Patent: May 12, 1992

[54] DOCUMENT TRANSFER DEVICE FOR MULTIPLE PASS DOCUMENT SORTING MACHINE

[75] Inventors: David J. Tilles, Baltimore; Stanley K. Wakamiya, Ellicott City; Bruce A. Krein, Columbia; Dale H. Brown, Glen Burnie, all of Md.; Sharon A. Duggan, Washington, D.C.; Mark S. Schroeder, Severna Park, Md.

[73] Assignee: Westinghouse Electric Corp., Pittsburgh, Pa.

[21] Appl. No.: 502,009

[22] Filed: Mar. 30, 1990

[51] Int. Cl.[5] ..... B65H 39/10

[52] U.S. Cl. ..... 271/297; 271/298; 271/305; 271/181; 271/215; 271/220

[58] Field of Search ..... 271/177, 180, 181, 287, 271/288, 297, 298, 305, 213, 214, 215, 217, 218, 220; 414/789.9, 790, 790.1, 790.3

[56] References Cited

U.S. PATENT DOCUMENTS

| | | | |
|---|---|---|---|
| 4,106,636 | 8/1978 | Ouimet et al. . | |
| 4,275,875 | 6/1981 | Akers | 271/5 |
| 4,328,962 | 5/1982 | Akers | 271/12 |
| 4,621,798 | 11/1986 | Akers | 271/5 |
| 4,674,934 | 6/1987 | Honger | 271/177 X |
| 4,772,003 | 9/1988 | Nobuta et al. | 271/181 X |

FOREIGN PATENT DOCUMENTS

| | | | |
|---|---|---|---|
| 1094233 | 12/1960 | Fed. Rep. of Germany | 271/180 |

*Primary Examiner*—David H. Bollinger
*Attorney, Agent, or Firm*—N. A. Nixon

[57] ABSTRACT

A document transfer system for receiving a cluster of stacked documents within the first end of an output holder and, by using movable partitions, advancing the clusters to the second end of the output holder, thereby permitting a next document cluster to be received within the output holder at the first end. A document cluster at the second end of the output holder is then, using extendable and retractable gates, transferred from the output holder to a separate holder for further processing.

32 Claims, 22 Drawing Sheets

DOCUMENT TRANSFER DEVICE FOR MULTIPLE PASS DOCUMENT SORTING MACHINE

BACKGROUND OF THE INVENTION

This invention relates to document sorting devices and more specifically to a document transfer device for document sorting machines.

Document sorting devices are beneficial to any business in which a large number of documents must be sorted and processed. Generally, documents are deposited upon an input holder and sorted to a plurality of output holders. Since a large number of documents are involved, for a complete sort it would be necessary to provide one output holder for each document or one output holder for each group of documents.

Space and cost limitations dictate a relatively small number of output holders regardless of the number of documents to be sorted. Because of this, in order to achieve proper sorting of a large number of documents when a relatively small number of output holders exist, it is necessary to execute multiple sorting passes. In this manner, after a specified number of sorting passes, documents will be deposited within the output holders in the desired sequence.

A mail-sorting machine capable of multiple pass document sorting is described in U.S. Pat. No. 4,275,875 entitled "Mail Sorting Machine" by Roy Akers and is incorporate herein by reference for the purpose of illustrating the state of the prior art. After a single sorting pass, the documents deposited within the output holders must be removed and deposited into the input holder. This must be done before subsequent sorting passes may be initiated since output holders must be empty to receive the next pass of newly sorted documents. Furthermore, documents are physically carried from the output holders to the input holder.

It is an object of this invention to provide a document transfer device capable of moving a document cluster from the receiving area so that a next document cluster from a subsequent sorting pass may be accepted in the receiving area.

It is another object of this invention to eliminate the need for manually transferring document clusters from the output holders to the induction subsystem.

It is furthermore an object of this invention to automate the process of transferring document clusters from the output holders to the induction subsystem.

SUMMARY OF THE INVENTION

A document transfer system for moving a cluster with a front and a back face of accumulated stacked documents from a receiving area at the first end of an output holder having first and second ends to the second end of the output holder and subsequently accepting a next cluster of stacked documents into the receiving area for transfer to the second end of the output holder, said system comprising an output holder partition, means for permitting movement of the output holder partition between the first and second ends of the output holder, and means for orienting the output holder partition in an extended orientation to contact the back face of the cluster and in a retracted orientation to avoid contact with the cluster with the output holder partition having an initial extended orientation at the output holder first end.

The system also comprises a sweeper partition, means for moving the sweeper partition between the first end of the output holder to at least the second end of the output holder, means for orienting the sweeper partition in an extended orientation to contact the front face of the cluster and in a retracted orientation to avoid contacting the cluster, with the sweeper partition having an initial retracted orientation at the output holder first end and an output holder gate at the second end of the output holder to stop the document cluster when the cluster is moved to the output holder second end, whereby the sweeper partition, when a cluster has accumulated within the output holder first end, is oriented in an extended orientation and advanced to advance an accumulated document cluster in the output holder receiving area against the output holder partition which is in an extended orientation to the second end of the output holder, the output holder partition then is retracted and returned to the initial extended position, and a next cluster may be provided to the receiving area of the output holder.

DESCRIPTION OF THE PREFERRED EMBODIMENT

Figure 1:
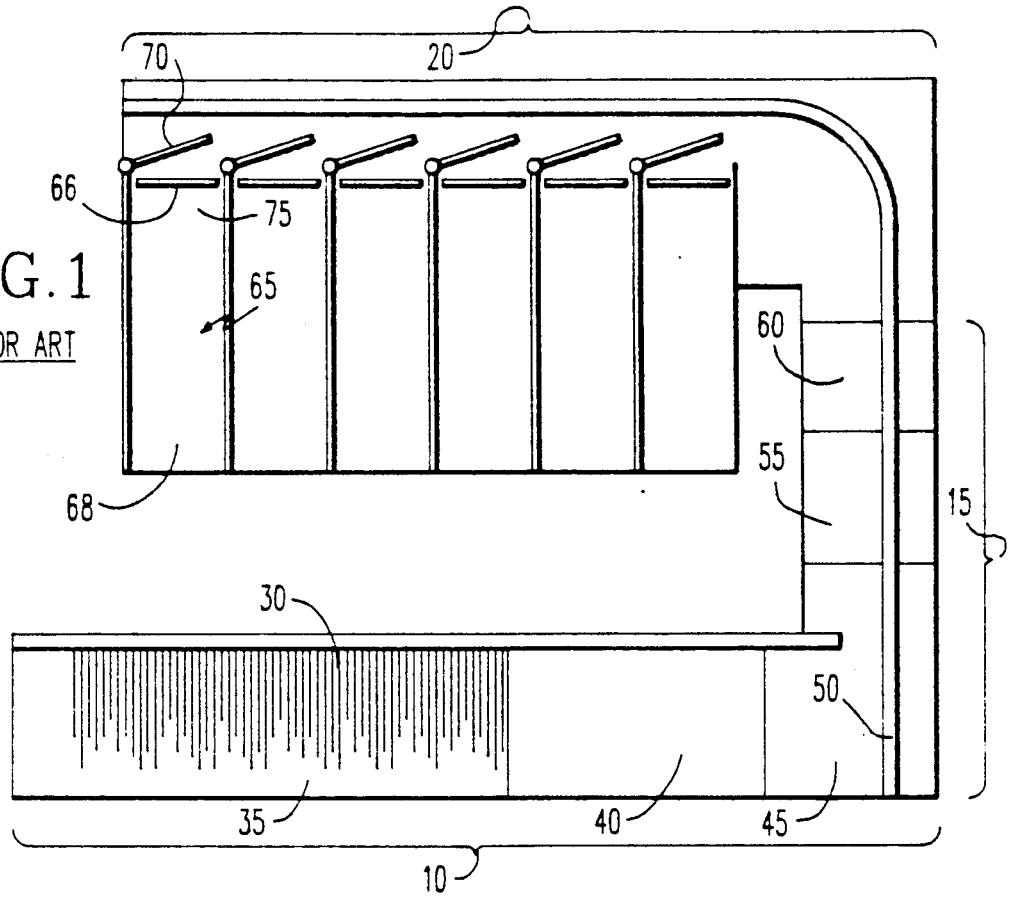
FIG. 1 PRIOR ART
FIGS. 1-3 are prior art and show a schematic plan view of a multiple pass document sorting device ready to initiate a sorting pass, a schematic plan view after a sorting pass has been initiated and a schematic plan view after a sorting pass has been completed, respectively.

A typical document sorting device shown in FIG. 1 is generally comprised of four parts: an induction subsystem 10, a reader subsystem 15, a stacker subsystem 20, and a recirculation subsystem(not shown). Typically a plurality of stacked documents 30, which for the purpose of this discussion and for convenience will be envelopes, are introduced into the induction subsystem 10. The induction subsystem 10 is generally comprised of a vibrating table 35, a conveyor 40 and a feeder 45. The documents are placed upon the vibrating table 35 which acts to align the documents along a common edge and then, via the conveyor 40, transported to the feeder 45. The feeder 45 proceeds to move the leading document of the stacked documents 30 to the reader subsystem 15. Generally stacked documents are introduced to the induction subsystem at an input holder 47. In FIG. 1 this is the same as the vibrating table 35 but may be at a point before the vibrating table 35.

The reader subsystem 15 is generally comprised of the leveling section 55 and the document reader 60. Singular documents from the feeder 45 proceed along a transport guideway 50 encountering the leveling section 55 and the document reader 60. The document reader may be an optical scanner or any other such device capable of scanning and interpreting data contained on each document. One such example of data would be a barcode scheme imprinted upon an envelope such as a piece of mail indicating a specific zip code.

Figure 2:
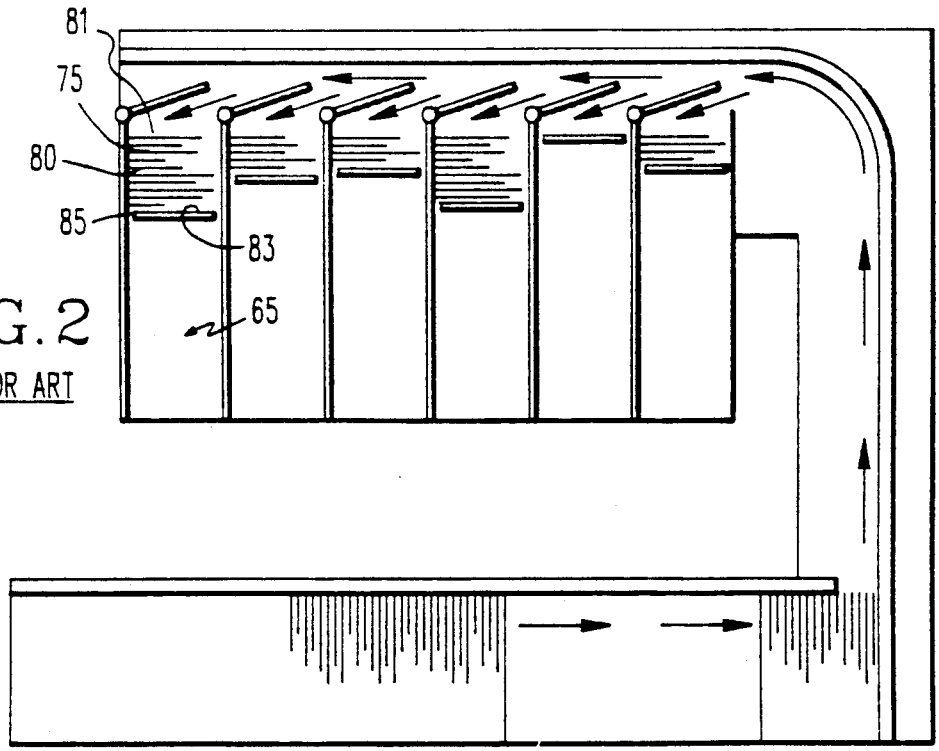
FIG. 2 PRIOR ART

Once a document is read, the information provided is utilized in the execution of a document sort algorithm to determine where the document should be directed, along the transport guideway 50, within the stacker subsystem 20. The stacker subsystem 20 is comprised of a plurality of output holders 65 each having a first end 66 and a second end 68 and each having a document diverter 70 capable of diverting a document from the transport guideway 50 into the appropriate receiving area 75 of an output holder 65 as directed by the document sorting algorithm. The receiving area 75 is located at the first end 66 of the output holder 65. As single documents are directed to each output holder 65, document clusters (not shown) begin to form within the receiving area 75 of each output holder 65. Referring to FIG. 2 the document clusters 80 accumulate in the output holders 65. Output holder dividers 85 which are movable along the length of the output holders 65 and are biased to resist movement away from the first ends 66 of the output holders 65, are displaced and act to compress each document cluster 80 during the sorting operation. Each document cluster 80 has a front face 81 and a back face 83. When a document cluster 80 is removed from the output holder, the associated output holder divider 85 returns to its original position within the receiving area 66 of the output holder 65 as shown in FIG. 1. While the device shown in FIG. 1 has only six output holders, a typical multiple pass document sorting device may have at least ten output holders. Generally for the purpose of this discussion only a single document cluster and output holder will be discussed. It should be noted that a plurality of document clusters and document holders exist and that the same discussion will apply to each.

Figure 3:
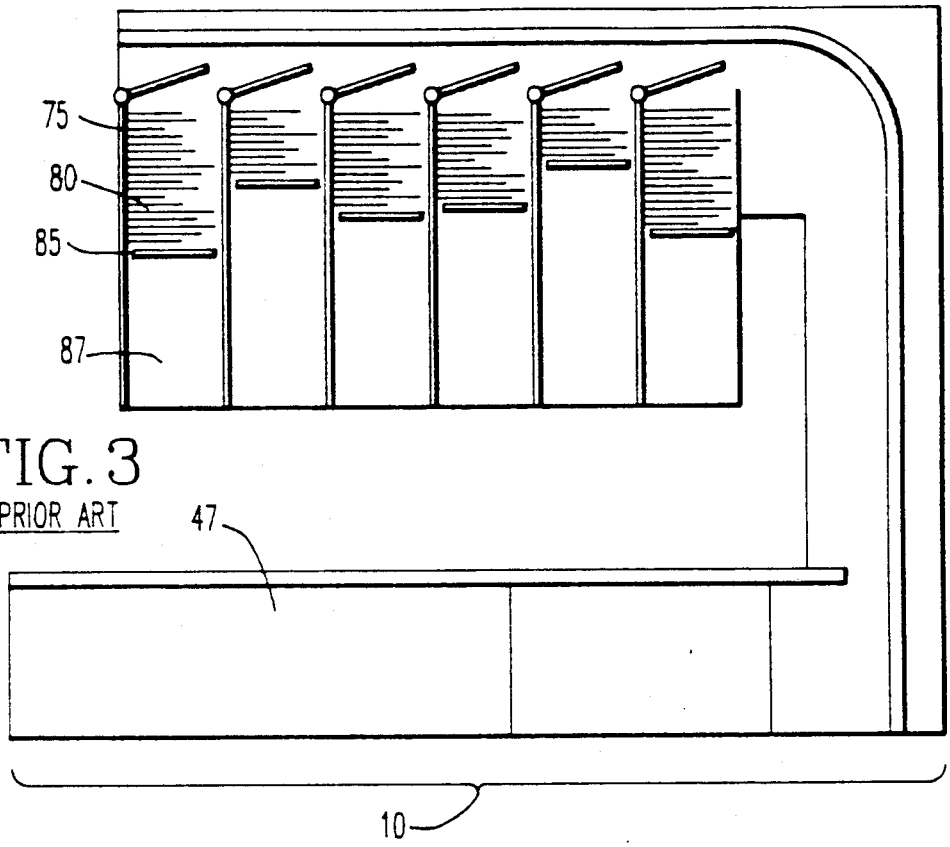
FIG. 3 PRIOR ART

As shown in FIG. 3 after all of the documents of the stacked documents are introduced into the induction subsystem 10 and sorted within the appropriate output holder 65, thereby forming document clusters 80 within the output holders, then a single sorting pass has been completed. In order to initiate a next sorting pass in the multiple pass document sorting device, it is necessary to sequentially transfer each document cluster 80 (FIG. 3) from the output holders 65 to the input holder 47 of the induction subsystem 10. It is only after all of the document clusters 80 are removed from their respective output holders 65 and transferred to the induction subsystem 10 that a next sort may be initiated.

Since each document cluster may have a large volume of documents and there may exist a plurality of output holders 65 greater than the number shown in FIGS. 1 through 3, it can be seen that transferring document clusters from the output holders 65 to the induction subsystem 10 may be fairly time-consuming. During this time the entire multiple pass document sorting device is inactive.

Furthermore, the process of transferring document clusters 80 from the receiving area 75 of the output holders 65 to the input holder 47 of the induction subsystem 10 is currently performed manually. An operator lifts a document cluster 80 from an output holder 65 and carries the cluster 80 over to the input holder 47. This creates a vulnerable link in the sorting process since it is possible for the operator to drop a document cluster 80, thereby requiring re-execution of the entire multiple pass sorting process. Furthermore the process of transferring document clusters 80 from the output holders 65 to the induction subsystem 10 is a fairly monotonous task and one that lends itself to automation.

While the configuration shown in FIG. 3 illustrates document clusters 80 in the respective receiving areas 75 of the output holders 65, before a next sorting pass may be initiated, these document clusters 80 must be moved onto the input holder 47 of the induction subsystem 10. Rather than suspending all sorting activity while each individual document cluster is transferred to the input holder 47 of the induction subsystem 10, it is possible to displace each document cluster 80 away from the receiving area 75 to a transitional area 87 of the output holders 65 and to transfer at least one document cluster 80 to the induction subsystem 10 and initiate a next sorting pass.

Throughout the discussion, reference will be made to a single output holder. It should be understood that a sorting device such as that shown in these drawings has a plurality of output holders and that discussion of one holder and the associated elements will apply to each of the other output holders. Because the sorting process is not instantaneous, once an initial document cluster 80 is introduced to the induction subsystem 10, while the documents of that cluster are being sorted subsequent document clusters may be removed from the output holders 65 and introduced into the induction subsystem 10. While these subsequent document clusters are being transferred the sorting process may be executed, thereby resulting in suspension of the sorting process only for the amount of time required to transfer the first document cluster to the induction subsystem 10.

Figure 4:
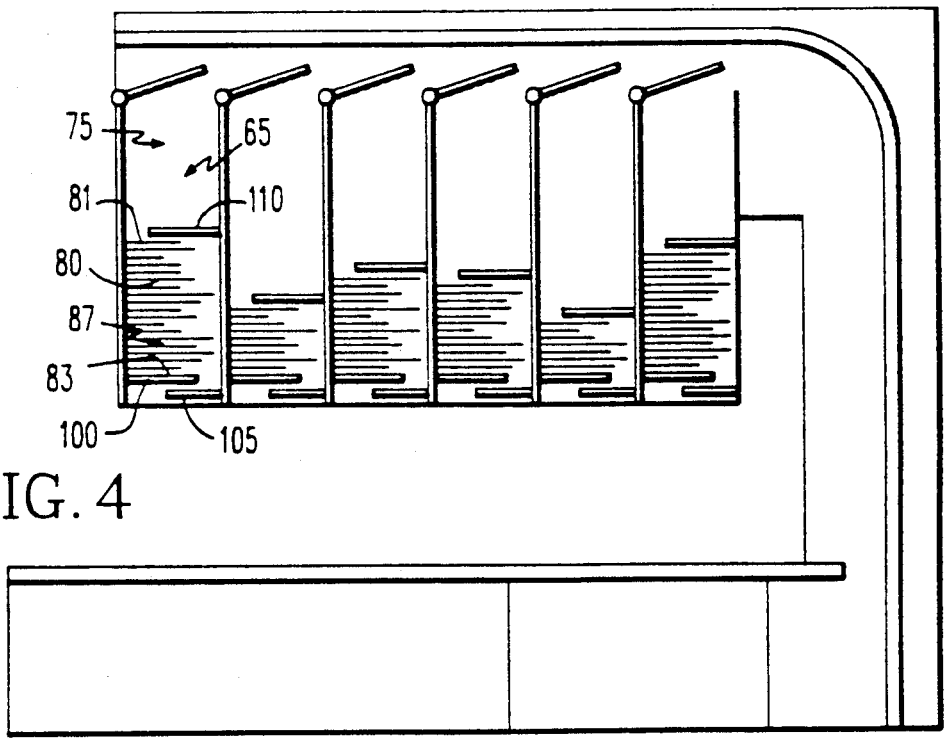
FIGS. 4 through 7 are schematic plan views of a sorting device showing the sorting process in which document clusters are isolated to permit a subsequent sorting pass to be initiated before all document clusters from the output holders are transferred to the induction subsystem.

FIG. 4 shows all of the document clusters 80 moved away from the receiving area 75 and into a transitional area 87 of the output holders 65. Considering that typically a sorting device may have many more output holders than shown in FIG. 4, it is clear the time saved for multiple sorting passes in initiating a sorting pass as soon as at least one document cluster is transferred, as opposed to transferring all document clusters to the induction system before initiating a sort, is substantial.

The output holder dividers 85, shown in FIG. 1–3, are capable only of movement along the length of an output holder 65 and in order to move document clusters 80 away from the receiving area 75 of an output holder 65 these are not adequate. It is necessary to modify the process and parts associated with an output holder to move the document clusters 80. Given document clusters 80 similar to those found in FIG. 3, a means for moving each document cluster 80 away from the receiving area 75 of the output holder 65 is necessary.

In lieu of the output holder divider 85, an output holder partition 100, an output holder gate 105, and a sweeper partition 110 will be added as shown in FIG. 4. A sweeper partition 110 is placed against the front face 81 of a document cluster 80 and the sweeper partition 110 is advanced against the output holder partition 100 from the receiving area 75 into the transitional area 87. In doing so, the document cluster 80 is compressed against the output holder partition 100 as the document cluster 80 travels along the length of the output holder 65. This is done for each output holder 65 so that each document cluster 80 is moved from the receiving area 75 into the transitional area 87 as shown in FIG. 4.

Figure 5:
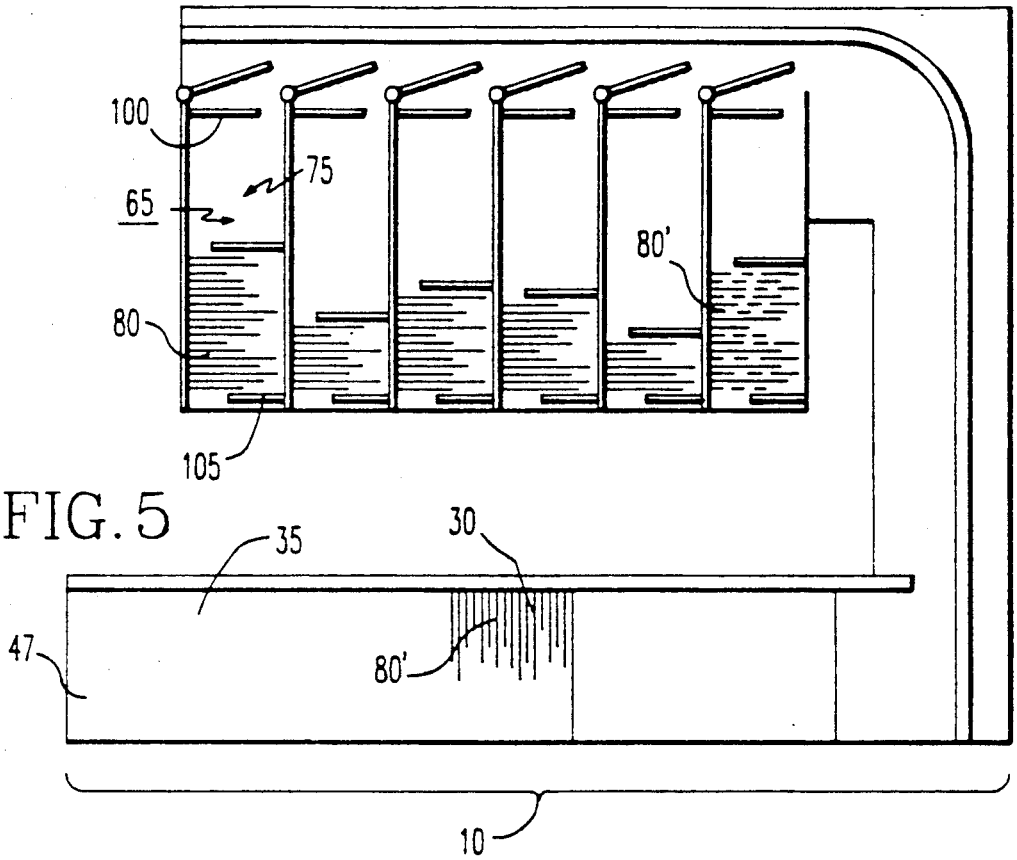

In order to initiate a next sorting pass, it is necessary to return each output holder partition 100 as shown in FIG. 5 to the respective receiving area 75 so that newly sorted documents, which are not yet shown in place, upon entering the appropriate output holder 65 will be maintained in a compressed stack. As shown in FIG. 5 this is done by moving the output holder partition 100 away from the document cluster 80 and returning the output holder partition 100 to its original position within the region of the receiving area 75 of the output holder 65. In doing so, the document cluster 80 now rests against the output holder gate 105 of each output holder 65.

With the output holder partitions 100 in place, at least one document cluster 80' may be removed from an output holder and introduced to the input holder 47 of the induction subsystem 10 as a group of stacked documents 30. If there is a small number of documents within the first document cluster 80' to be transferred from an output holder 65 to the input holder 47 of the induction subsystem 10, it may be necessary to transfer a second or third document cluster to the induction subsystem 10. This is determined by the rate at which the sorting device can accept and process documents for distribution within the output holders 65.

It is significant that only one document cluster or a small number of document clusters must necessarily be transferred to the induction subsystem 10 before the next sorting pass may be initiated. This permits a sorting pass to be initiated before all of the document clusters 80 are transferred to the induction subsystem 10, thereby maximizing the sorting throughput by minimizing the amount of time the sorting device is not operating.

Figure 6:
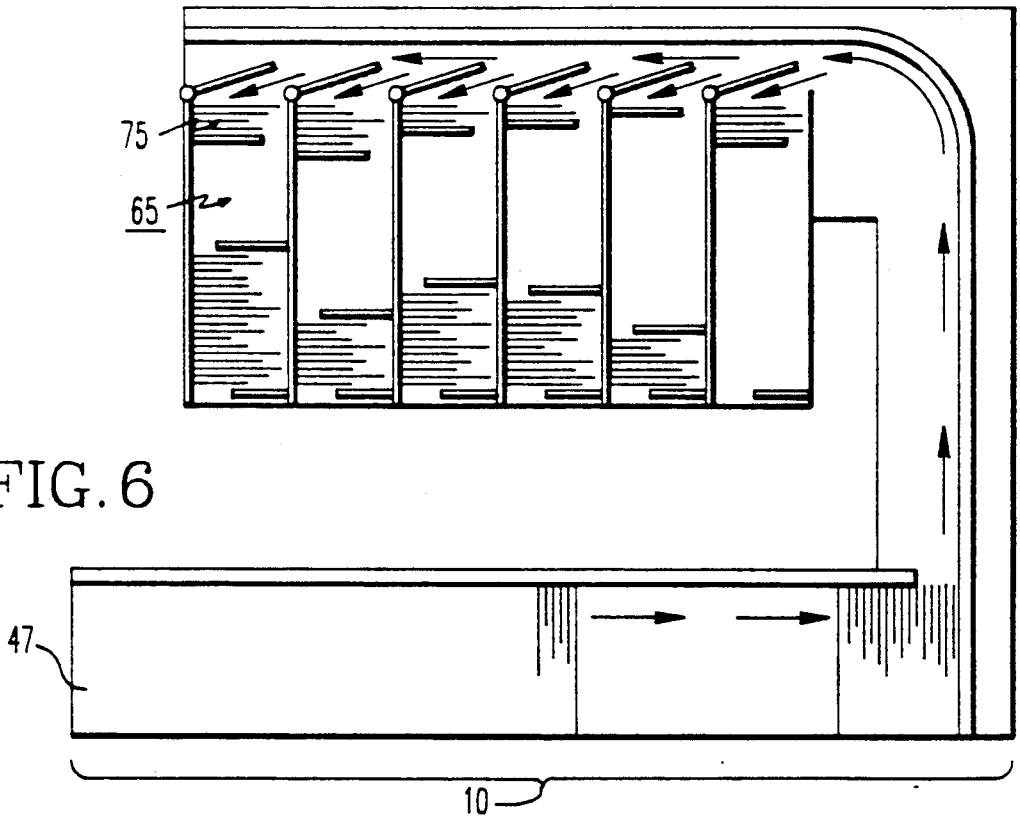

FIG. 6 illustrates the sorting device with a sort initiated after only one document cluster (80' of FIG. 5) has been transferred to the induction subsystem 10. Note that document clusters have begun to form within the receiving area 75 of each output holder 65. In this manner, a machine operator, after transferring a first document cluster (80' of FIG. 5), can initiate a sorting pass (FIG. 6) and subsequently transfer the remaining document clusters to the input holder 47 of the induction subsystem 10, as shown in FIG. 7, thereby maximizing document throughput for sorting.

Figure 7:
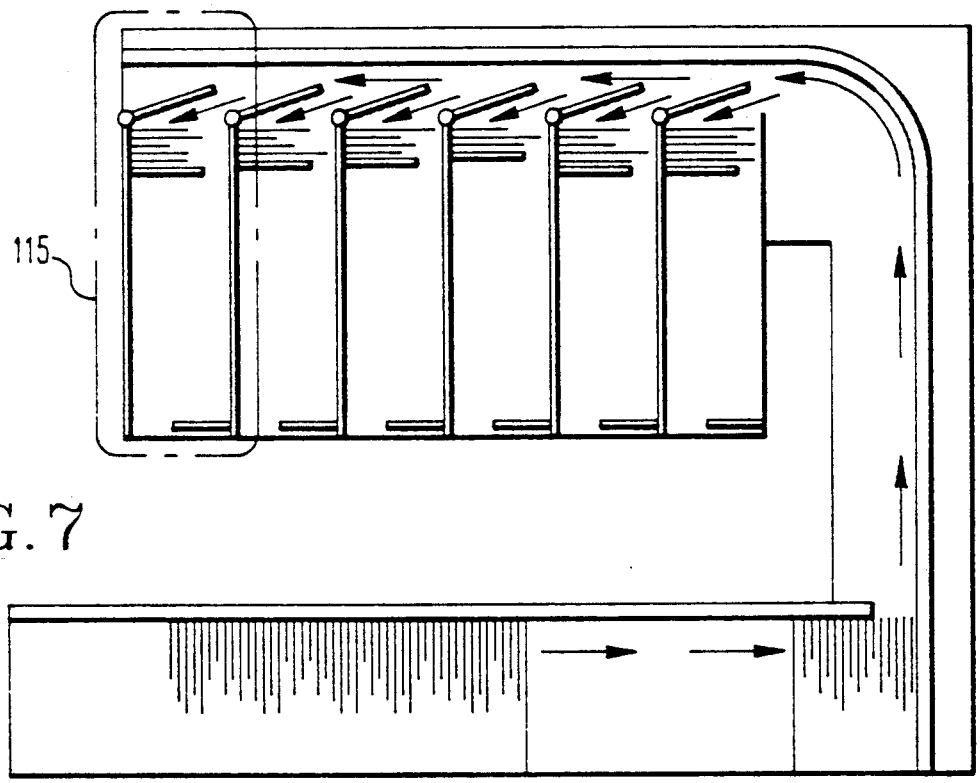

While a cursory overview was provided with FIGS. 4 through 7 on the operation of the method and apparatus utilized to transfer document clusters away from the receiving area and into a transitional area of an output holder, FIGS. 8 through 13 provide details. FIG. 7 shows an encircled area 115 which will be shown in detail using FIGS. 8 through 13. The purpose of the mechanism shown in FIGS. 8 through 13 is to displace the document cluster away from the receiving area 75 and into the transitional area 87 of an output holder 65.

Figure 8:
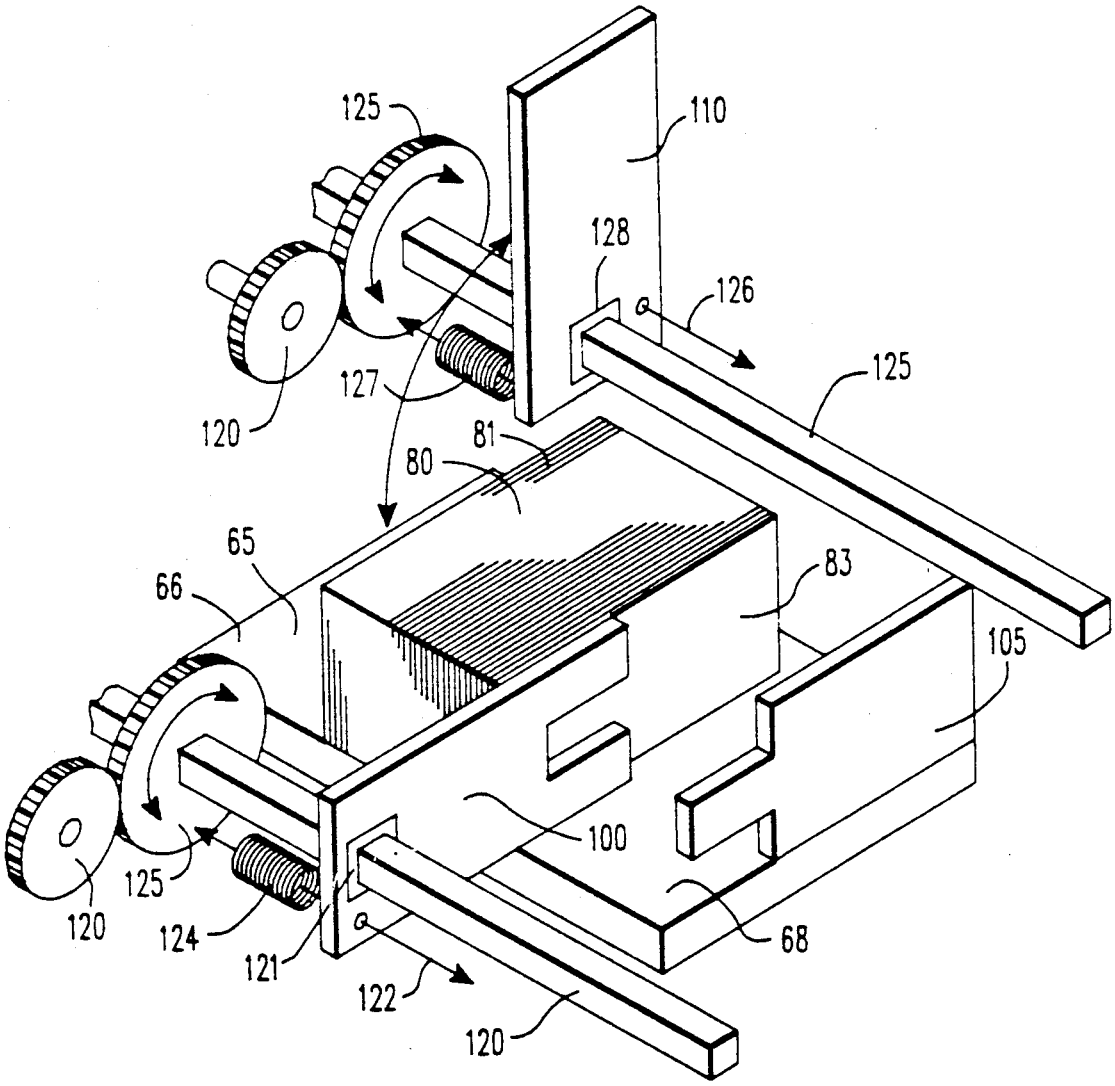
FIGS. 8 through 13 show isometric drawings illustrating the method and apparatus by which the document clusters are moved away from the receiving area of an output holder.

FIG. 8 shows an isometric drawings of an output holder 65 having a first end 66 and a second end 68. A document cluster 80 similar to those seen in FIG. 3 are accumulated within the output holder 65 after a complete single sorting pass as illustrated by the single document cluster 80 in FIG. 8. A document cluster 80 with a front face 81 and a back face 83 in the output holder 65 is compressed by an output holder partition 100. The cluster 80 front side 81 is held in place by an auger (not shown) or similar mechanism which may be located at the level of the output holder 65 so that the cluster 80 is between the auger and the output holder partition 100.

The output holder partition 100 shown in FIGS. 4 through 7 and in detail in FIG. 8, not only moves along the length of the output holder 65 and is biased toward the first end 66 of the output holder 65 similar to the output holder divider 85 shown in FIGS. 1 through 3, but has additional features.

The output holder partition 100 is movable between the first end 66 and beyond the second end 68 of the output holder 65. The partition 100 may be situated such that in an extended orientation, as shown in FIG. 8, the partition 100 contacts the back face 83 of the document cluster 80. The partition may also be situated in a retracted orientation, such as that shown by item 110, in which the partition 110 does not contact the document cluster 80.

While the movement and orientation of the partition 100 may be accomplished in any number of ways, FIG. 8 illustrates an output holder partition 100 which travels via a set of bearings 121 on the partition 100 along a rectangular shaft 120 and is capable of being situated in a retracted orientation by rotating the rectangular shaft 120. Furthermore, the output holder partition 100 is biased toward the output holder first end 66. The holder partition 100 may be resiliently biased using means such as a spring 124. The output holder partition 100 may be moved along the shaft 120 using a wire 122 to pull the partition 100 to the desired location.

A sweeper partition 110, in a similar manner to that of the output holder partition 100, is capable of movement along the length of the output holder 65 through movement on a sweeper partition shaft 125. In the same manner as output holder partition 100, the sweeper partition 110 is movable but between the first end 66 and the second end 68 of the output holder 65. However the sweeper partition 110 is not resiliently biased toward the first end 66 of the output holder 65. The sweeper partition 110 may be situated such that in an extended orientation, similar to that shown by item 110 in FIG. 9, the partition 110 contacts the front face 81 of the document cluster 80. The partition 110 may also be situated in a retracted orientation, such as that shown by item 110 in FIG. 8, in which the partition 110 does not contact the document cluster 80. The sweeper partition 110 may be moved along the shaft 125 using wires 126 and 127 on each side of the partition 110.

Figure 9:
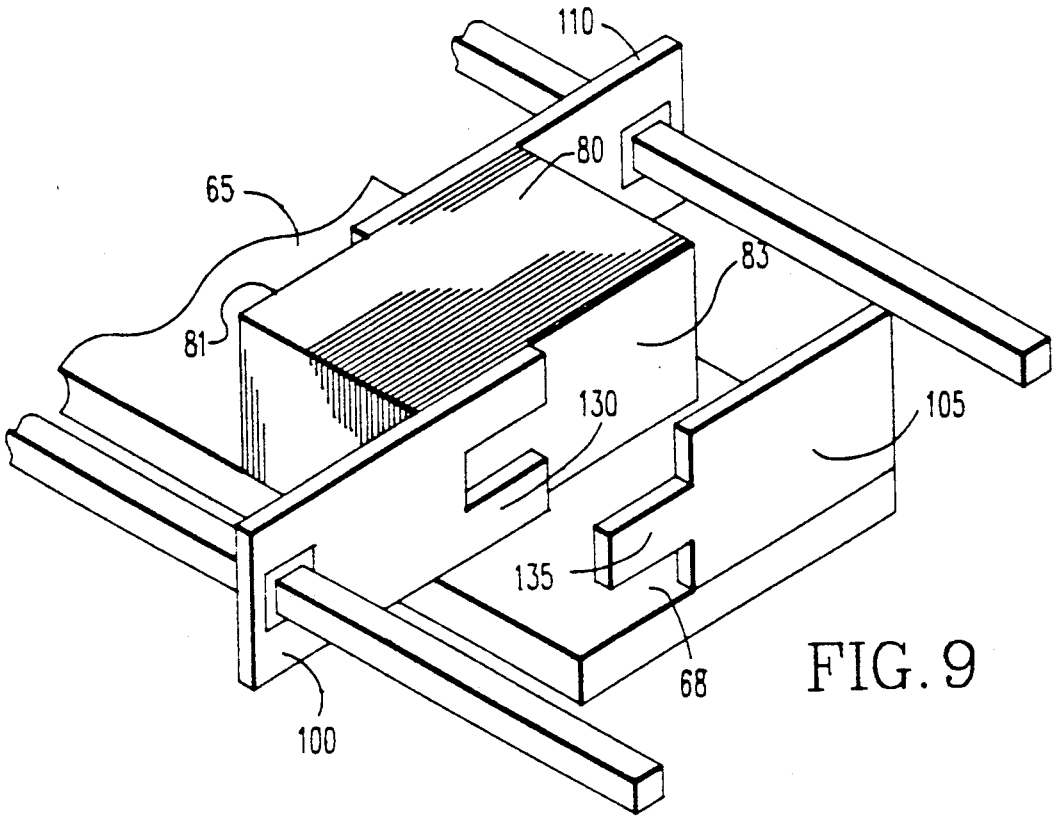

The sweeper partition 110 is originally positioned at the first end 66 of the output holder 65 in a retracted orientation as shown in FIG. 8. As shown in FIG. 9 after a document cluster has accumulated in a receiving area 75 of an output holder 65, the sweeper partition 110 is situated such that the sweeper partition 110 contacts the front face 81 of a document cluster 80 while the output holder partition 100 contacts the back face 83 of the document cluster 80.

While the movement and orientation of the partition 110 may be accomplished in any number of ways, FIG. 8 illustrates a sweeper partition 110 which travels via a set of bearings 128 on the sweeper partition 110 along a rectangular shaft 125 and is capable of being situated in a retracted orientation by rotating the rectangular shaft 125. Note that while both the output holder partition 100 and the sweeper partition 110 have been described as movable along rotatable rectangular shafts 120 and 125, respectively, other motions or designs are possible to accomplish the task of moving each partition such that it is capable of contacting or not contacting the face of a document cluster. As one example the shafts 120 and 125 may not rotate and each partition may have a pivotal connection such as a hinge upon a shaft and a means of rotating the partition on the pivotal connection. Furthermore, each partition could be vertically or horizontally displaced to contact or avoid contact with a document cluster. It would also be possible to secure the output holder partition 100 to the shaft 120 and to move the entire shaft 120 to position the output holder partition 100. It would also be possible to secure the sweeper partition 110 to the shaft 125 and to move the entire shaft 125 to position the sweeper partition 110.

As shown in FIG. 9, with the sweeper partition 110 contacting the document cluster front face 81, the sweeper partition 110 is advanced thereby advancing the document cluster 80 toward the second end 68 of the output holder 65.

Note the configuration of the output holder gate 105, located at the second end 68 of the output holder 65, and the output holder partition 100. The output holder gate 105 and the output holder partition 100 are designed such that the output holder partition 100 as it progresses along the output holder 65 may pass the output holder gate 105 in an unobstructed path. FIG. 9 presents a design using mateably configured interdigitated fingers 130 and 135 on the output holder partition 100 and the output holder gate 105 respectively by which the output holder partition 100 may move past the output holder gate 105 without interference, thereby transferring contact of the document cluster 80 to the output holder gate 105. Throughout this application it should be appreciated that the sweeper partition and the output holder partition may be situated in retracted orientations to slide away from contact with a document cluster or, in an alternative design, may move in an extended orientation past a mateably configured set of interdigitated fingers and in this manner move away from contact with a document cluster.

Figure 10:
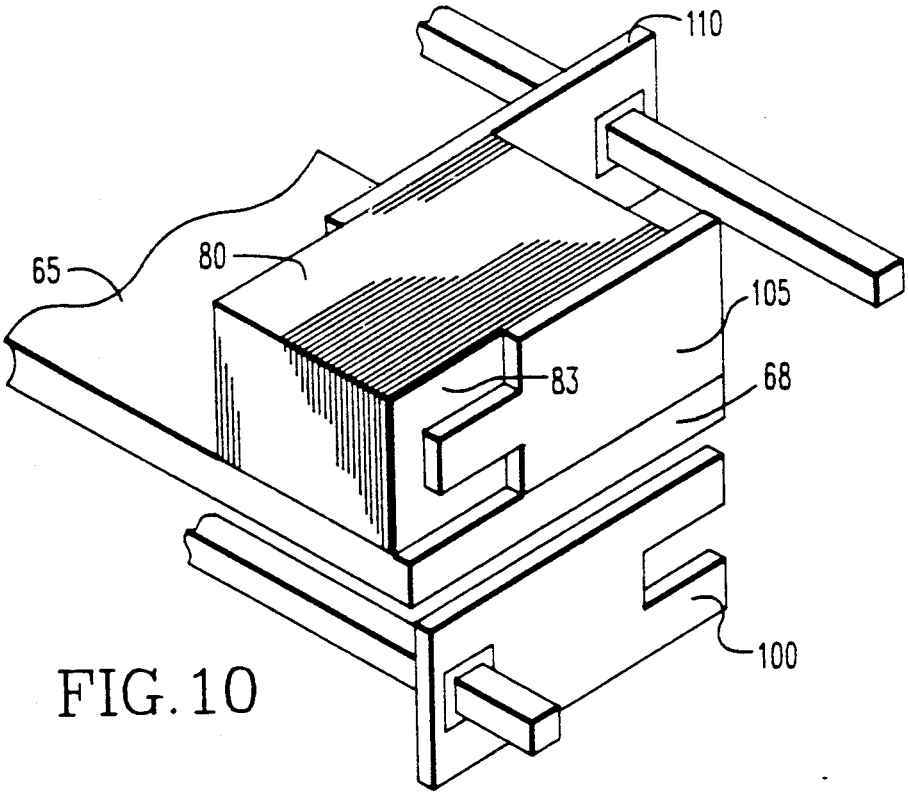

As shown in FIG. 10, the sweeper partition 110 continues to advance along the length of the output holder 65. In this manner the output holder partition 100, which is also being advanced with the sweeper partition 110 and the document cluster 80, may advance past the output holder gate 105. The sweeper partition 110 continues to advance until the back end 83 of the document cluster 80 contacts the output holder gate 105 located at the second end 68 of the output holder 65. At the point the document cluster back side 83 contacts the output holder gate 105, the document cluster 80 is then captured between the sweeper partition 110 and the output holder gate 105. At this point the output holder partition 100 continues to move via wire 122 beyond the output holder gate 105 such that the output holder partition 100 is no longer in contact with the document cluster 80. The output holder partition 100, once moved past the output holder gate 105, as illustrated in FIG. 10, is then free to return to its original position at the first end 66 of the output holder 65 in a retracted orientation and once at the first end 66, assume an extended orientation.

It is possible to avoid the necessity of the interdigitated fingers 130 and 135 if a design is utilized in which the output holder partition 100 is not required to move past the output holder gate 105. In this manner the output holder partition 100 would move with the document cluster 80 until the output holder partition 100 contacted the output holder gate 105. At this point the output holder partition 100 would be moved away from the document cluster 80 by sliding the partition 100 from between the cluster back face 83 and the output holder gate 105 and situating the partition 100 in a retracted orientation.

Figure 11:
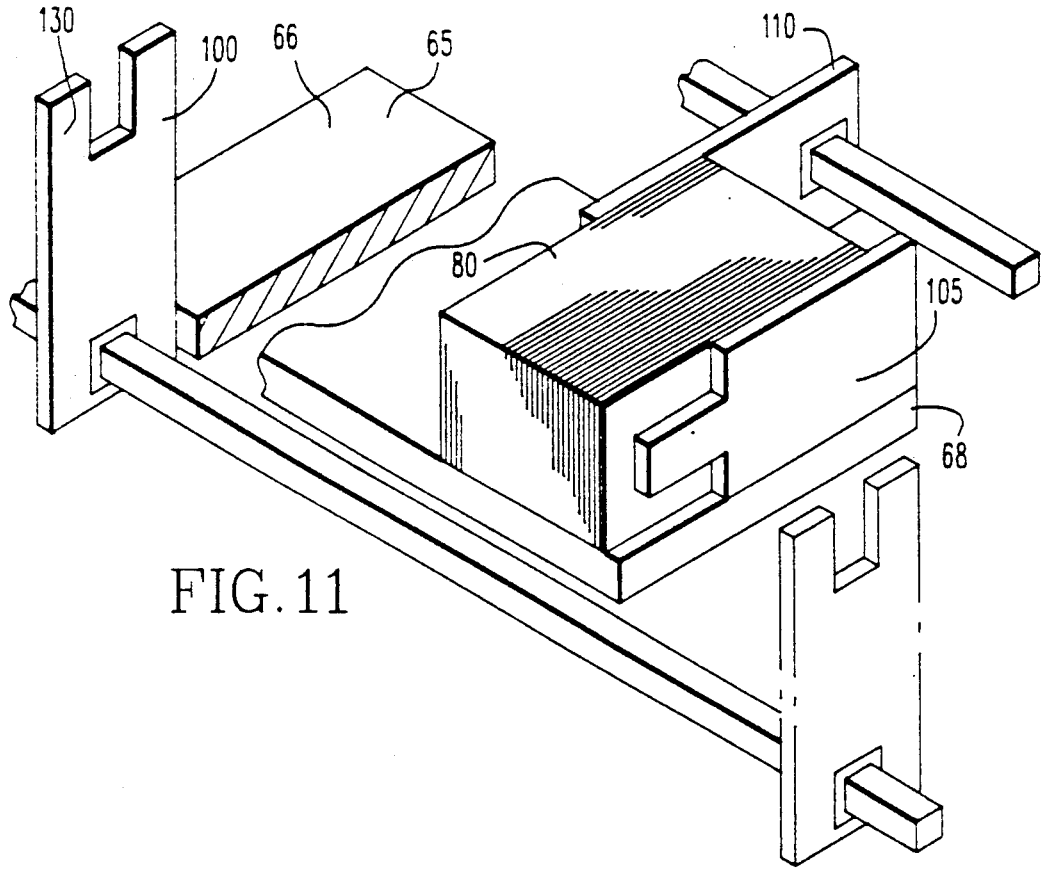
Figure 12:
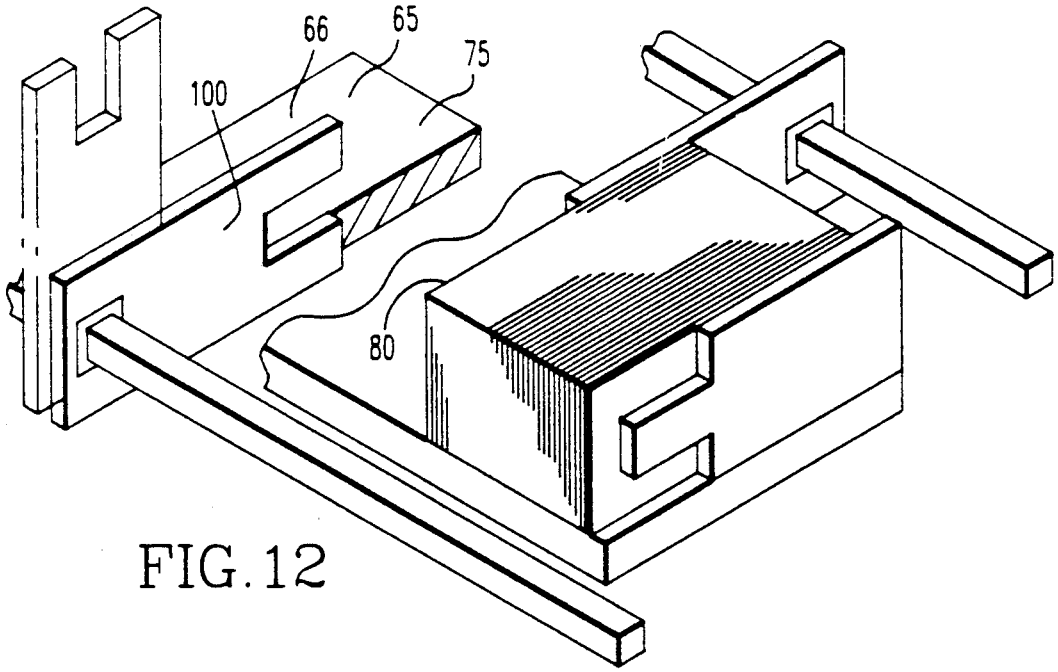

Once the output holder partition 100 is past the output holder gate 105, or away from the document cluster 80 as a result of sliding from the cluster 80, the partition 100 is returned to the original position as shown in FIG. 11. FIG. 11 also shows the output holder 65 with the document cluster 80 at the second end 68 of the output holder 65 captured by the sweeper partition 110 and the output holder gate 105 with the output holder partition 100 in a retracted orientation at the partition 100 initial position at the output holder first end 66. At this time the output holder partition 100 may be situated to the extended orientation such that it is in position at the output holder first end 66, as shown in FIG. 12, to receive documents from a next sorting pass. This configuration is similar to that shown with document cluster 80' in FIG. 5. At this point the document cluster 80 is removed from the transitional area 87 of the output holder 65 and transferred to the input holder 47 of the induction subsystem 10 similar to document cluster 80' shown in FIG. 5.

With a document cluster 80 moved away from the receiving area 75 to the transitional area 87 at the second end 68 of the output holder 65 and the output holder partition 100 at the initial position in an extended orientation as shown in FIG. 12, the document cluster 80 may now be removed from the output holder 65 and transferred to the input holder of the induction subsystem. Once the output holder partitions 100 at each output holder are returned to the initial position in an extended orientation, then a next sorting pass may be initiated and other document clusters may begin to form at each output holder. During this time another document cluster may begin to form at the output holder 65 receiving area 75.

Figure 13:
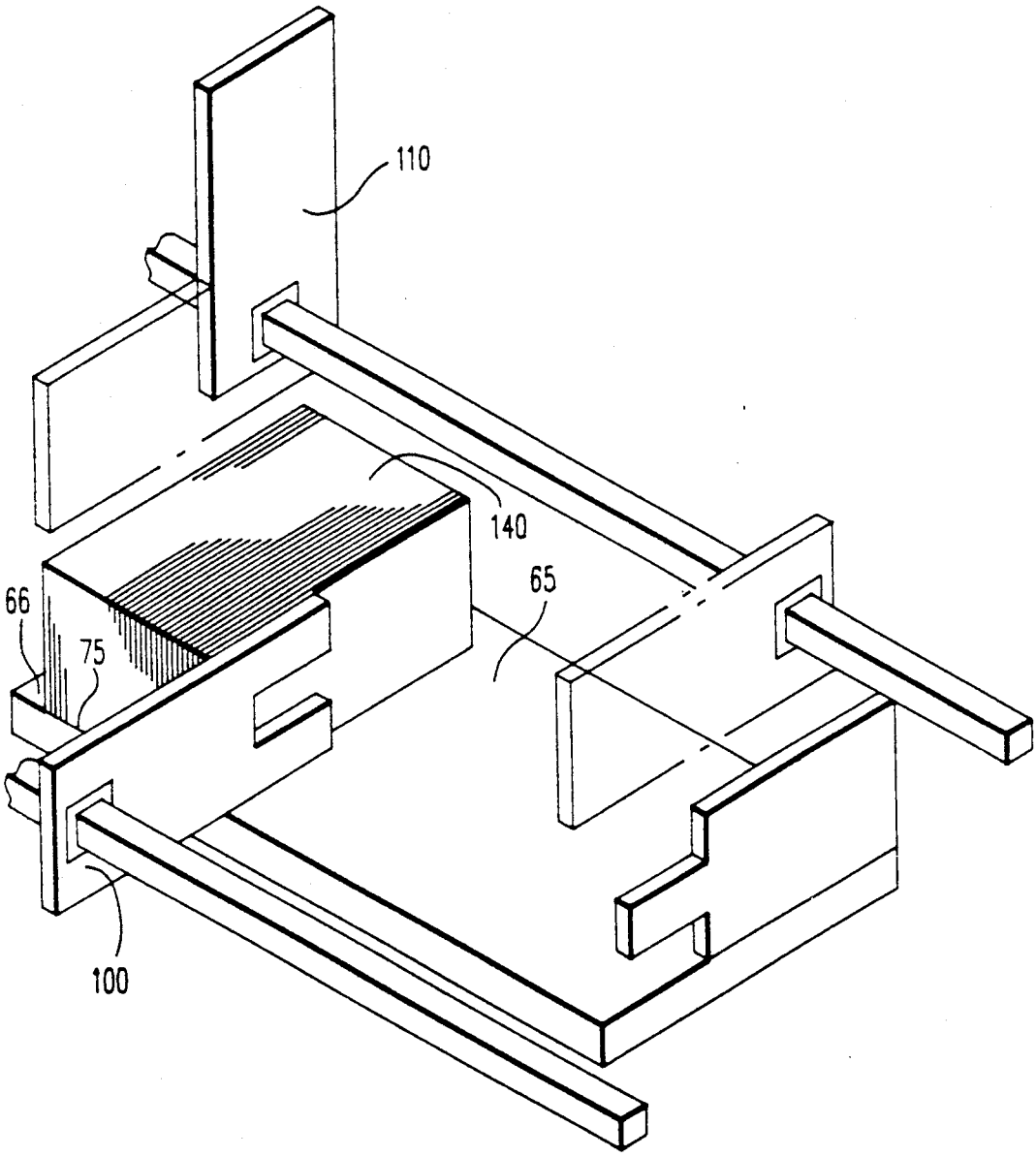

With the original document cluster removed, as shown in FIG. 13, the sweeper partition 110 may be situated to a retracted orientation at the first end 66 of the output holder 65. Once a new document cluster 140 has been formed, which occurs after the completion of the next sorting pass, then the sweeper partition 110 may be situated in the extended orientation and the steps illustrated in FIG. 8-12 repeated. Note that FIG. 13 resembles the configuration in FIG. 8.

While what has just been described is a sequence for displacing document clusters away from the receiving area and into the transitional area of an output holder with no indication of how documents are transferred from the output holder to the input holder of the induction subsystem.

Figure 14:
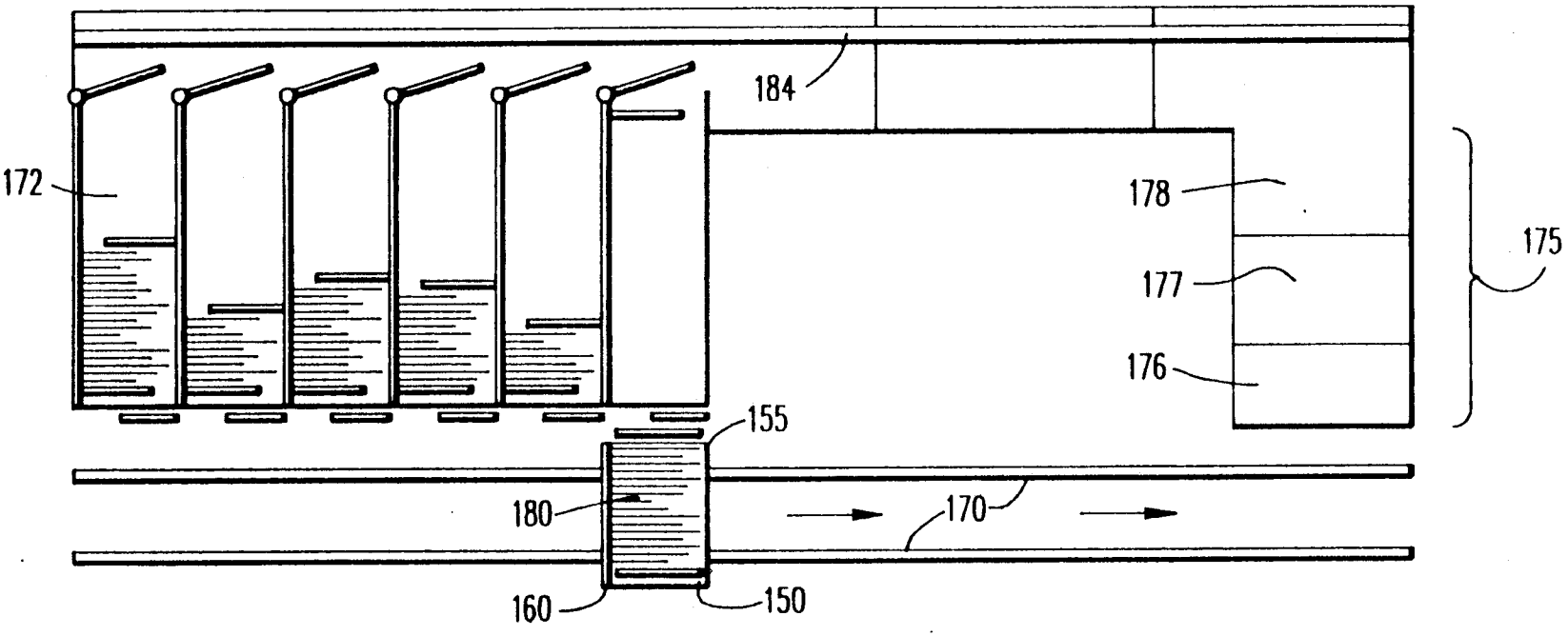
FIGS. 14 and 15 illustrate a schematic plan view of a multiple pass document sorting device utilizing a recirculation holder to transfer documents from the output holders to the induction subsystem of the sorting device.

FIG. 14 shows a sorting device with a recirculation holder 150 having a first end 155 and a second end 160. However in order to accommodate the use of a recirculation holder 150, it is necessary to reconfigure the sorting device. The induction subsystem 175 of the sorting device, which is generally comprised of a vibrating table 176, a conveyor 177 and a feeder 178, must be oriented such that it is capable of receiving documents from a document cluster 180 on the recirculation holder 150. To this end the induction subsystem 175 has been positioned differently from that of the induction subsystem 10 shown in FIGS. 1 through 6. Just as before, generally stacked documents are introduced to the induction subsystem at an input holder 179. In FIG. 14 this may be the same as the vibrating table 176 but also may be at a point before the vibrating table 176. The feeder 178 proceeds to move the leading document of a group of stacked documents, along a transport guide wave 184, to the reader subsystem, which as before is generally comprised of a leveling section and a document reader.

The recirculation holder 150 is movable along the entire length of the sorting device via rails 170 or another guiding means. The recirculation holder 150 is capable of being aligned with each output holder 172 and with the input holder 179 of the induction subsystem 175. Each output holder 172 is typical and has a first end 173 and a second end 174. Note the recirculation holder 150 and rails 170 may also be reconfigured to accommodate the input holder 47 of the induction subsystem 10 shown in FIG. 1. Once a document cluster 180 has been transferred to the recirculation holder 150 as shown in FIG. 14, the entire recirculation holder 150 is moved to a position as shown in FIG. 15 such that the recirculation holder 150 is aligned so that the document cluster 180 may be introduced to the input holder 179 of the induction subsystem 175.

The document cluster 180 is then introduced to the input holder 179 of the induction subsystem 175 and a sorting pass is initiated. At this point the recirculation holder 150 is moved such that it is aligned with another document cluster in another output holder. This document cluster is then transferred to the recirculation holder 150 and the holder 150 again moved along rails 170 such that the document cluster 180 once again aligns with the input holder 179 of the induction subsystem 175. The documents are then input to the input holder 179 of the induction subsystem 175 for further sorting. This iterative process is repeated until all of the document clusters have been removed from each output holder 172 and introduced to the input holder 179 of the induction subsystem 175.

The recirculation holder 150 may be manually moved back and forth between each output holder and the induction subsystem 175 or this process may be automated such that once each document cluster has been transferred from an output holder to the recirculation holder 150, the recirculation holder 150 may be automatically moved to align with the induction subsystem 175. After the document cluster is transferred to the induction subsystem 175, the recirculation holder 150 may then automatically shuttled to each of the remaining output holders, at which time each document cluster within those output holders 172 may be transferred to the recirculation holder 150 and then introduced to the input holder 179 of the induction subsystem 175 for a sorting pass.

Figure 15:
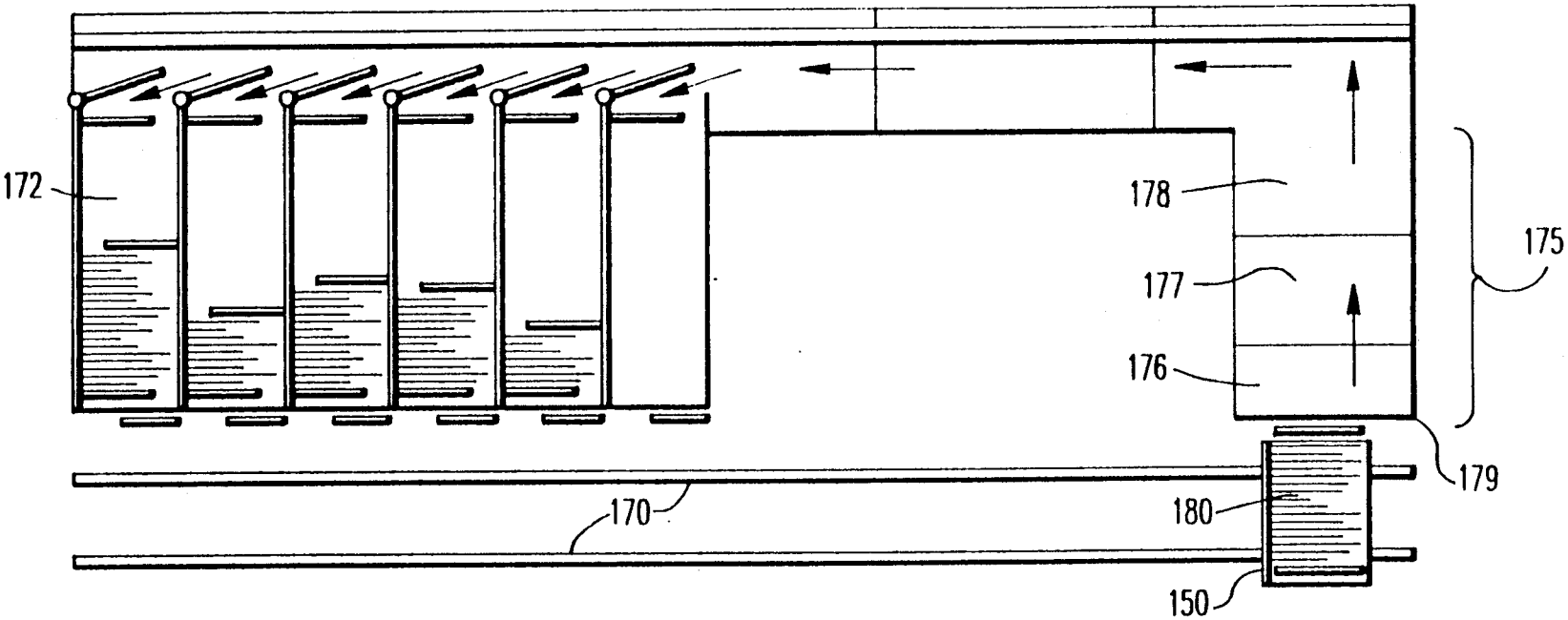

While FIGS. 14 and 15 provide a schematic for the movement of the recirculation holder 150, FIGS. 16 through 22 provide details on the apparatus and method for automatically transferring document clusters from an output holder 172 to the recirculation holder 150.

The apparatus and method used to move document clusters from the first area of the output holder toward the second end are similar to that described in FIGS. 8 through 13 with two variations. While the output holder partition 200 (FIG. 16) is of a similar design and operation to that of the output holder partition 100 in FIGS. 8 through 13, the output holder gate 205 and the sweeper partition 210 are modified from the output holder gate 105 in FIGS. 8 through 13 and the sweeper partition 110 in FIGS. 8 through 13.

Figure 16:
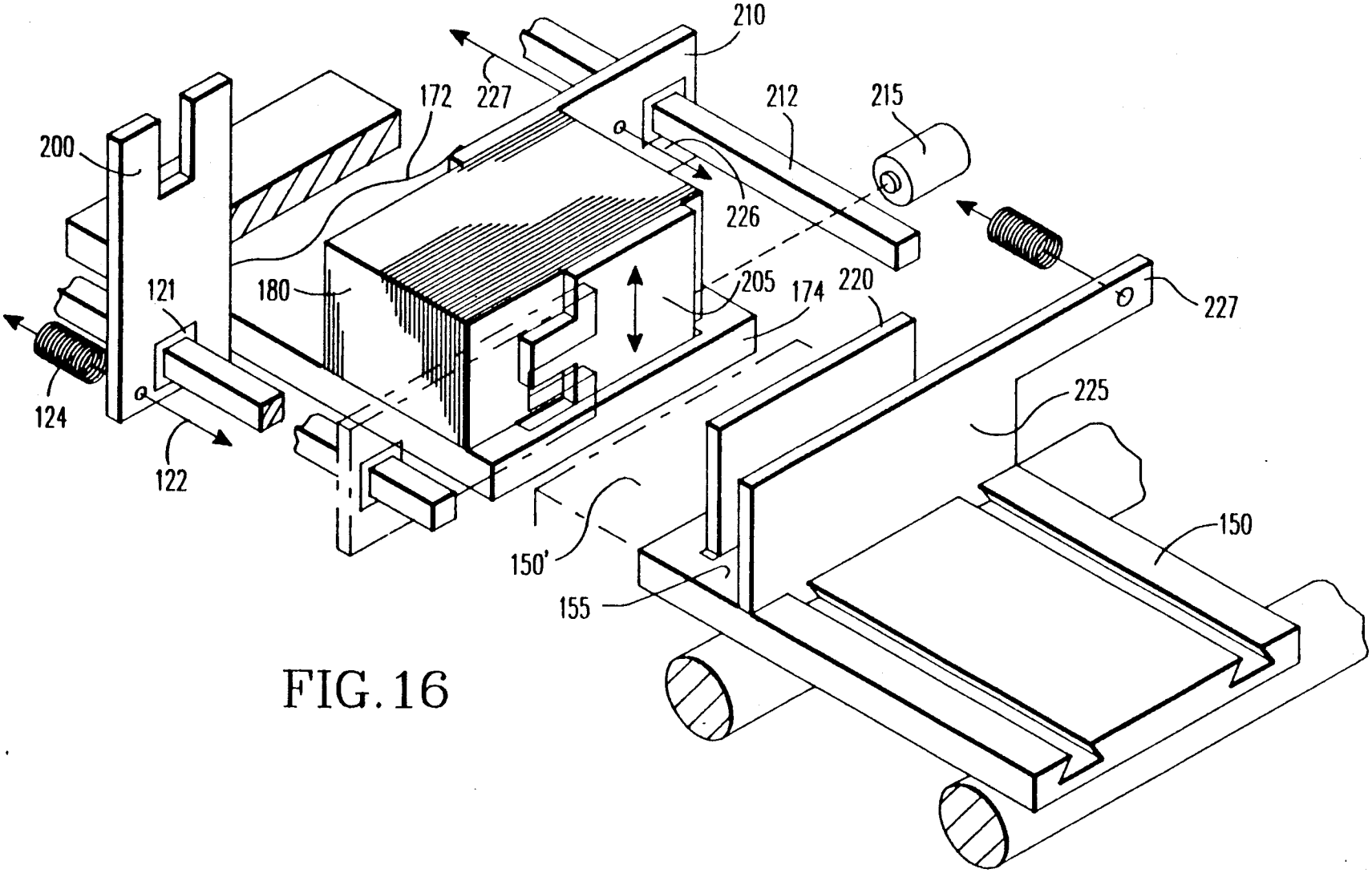
FIGS. 16 through 22 are isometric drawings illustrating the method and apparatus utilized to transfer a document cluster away from the receiving area of an output holder and onto a recirculation holder which is then utilized to feed the document cluster to the induction subsystem.
Figure 17:
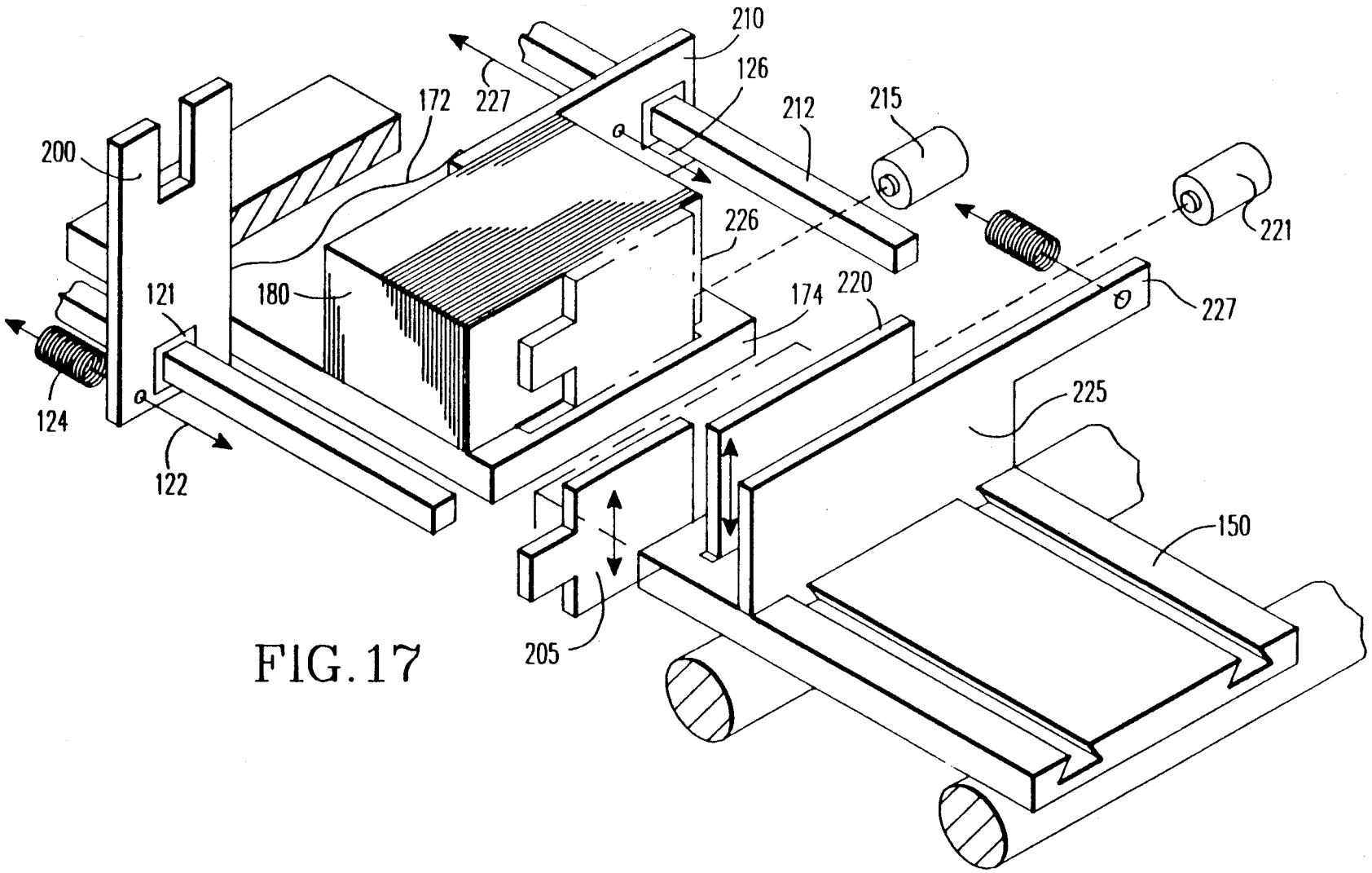

Unlike FIGS. 8 through 13, for the configuration shown in FIGS. 14 and 15 the document cluster must move beyond the output holder 172 and onto the recirculation holder 150. The travel of the sweeper partition 210 must then be beyond the output holder 172 and onto the recirculation holder 150. For this arrangement the shaft 212 for the sweeper partition 210 must extend beyond the output holder 172 such that a document cluster 180 may be advanced to the recirculation holder 150. Furthermore, output holder gate 205 must be capable of being moved away from the path of the document cluster 180 as it is advanced by the sweeper partition 210 onto the recirculation holder 150. This is possible by designing the output holder gate 205 such that it may be situated in an extended orientation capable of contacting the document cluster 180 as shown in FIG. 16 and such that it may also be situated in a retracted orientation in which it is not capable of contacting the document cluster 180 as shown in FIG. 17. This may be accomplished in a number of ways known in the art including sliding the output holder gate 205 to a level below the output holder 172 or by rotating the output holder gate 205 away from the path of the document cluster 180. For purposes of this discussion the output holder gate 205 will be displaced to a level below the output holder 172 using means for orienting 215. Slide mechanisms known in the art may be used for this.

Figure 18:
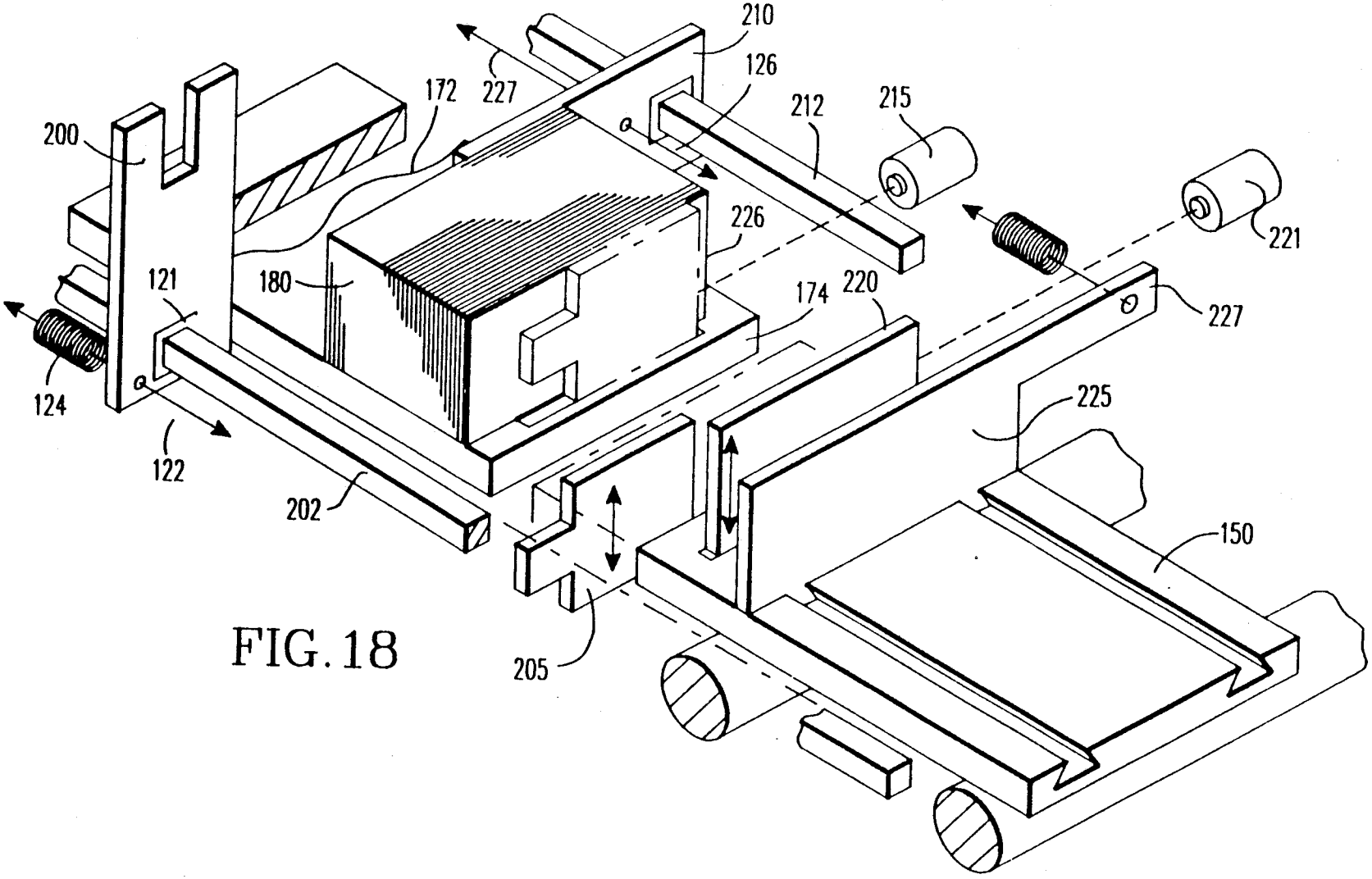

FIG. 16 shows an arrangement similar to that shown in FIG. 11, and the sequence of document cluster progression described in FIGS. 8 through 11 is identical to that shown for the output holder 172 in FIG. 16. An empty recirculation holder 150 is situated such that the first end 155 of the recirculation holder 150 is aligned with the second end 174 of the output holder 172 with the ends nearly flush such that a document cluster 180 may be moved to the recirculation holder 150. Item 150' shows the actual location of the recirculation holder 150 which for clarity is shown displaced. The recirculation holder 150 has vertically oriented at its first end 155 a recirculation holder gate 220 which, just as output holder gate 205, may be situated in an extended or retracted orientation. In the retracted orientation the path of an advancing document cluster 180 onto the recirculation holder 150 is unobstructed (as shown in FIG. 18).

The movement and orientation range of output holder partition 200 along shaft 202 is similar to that of output holder partition 100 along shaft 120 described in FIG. 8. The movement and orientation range of the sweeper partition 210 along shaft 212 is similar to that of the sweeper partition 110 along shaft 125 in FIG. 8 except now the sweeper partition 210 must be capable of displacing the document cluster 180 completely on to the recirculation holder 150. For this reason the shaft 212 must extend far enough beyond the output holder second end 174 to accomplish this.

Note that with the recirculation holder 150 nearly flush with the output holder 172 then the output holder partition 200 could contact the recirculation holder gate 220 as it passes the output holder gate 205. The output holder partition 200 shown in phantom in FIG. 16 illustrates this. Since the recirculation holder gate 220 is movable, then the output holder partition 200 would merely displace the gate 220 and then, once past the output holder gate 205, assume the retracted orientation. Furthermore, while ideally the recirculation holder 150 should abut against the output holder 172 to provide a continuous path for the document cluster 180 as it moves onto the recirculation holder 150, it is possible to provide a lip (not shown) extending from the output holder second end 174 or the recirculation holder first end 155 to provide a continuous path.

FIG. 17 shows the output holder gate 205 in a retracted orientation with the recirculation holder 150 aligned with the output holder 172. The output holder partition 200 and the sweeper partition 210 are movable along their respective shafts, 202 and 212, and capable of being oriented in an extended or retracted orientation in the same manner as those partitions 100 and 110 described in FIGS. 3-8. The output holder partition 200 has an output holder partition bearing 203 which is movable along the shaft 202 and the sweeper partition 210 has a sweeper partition bearing 213 which is movable along the shaft 212. In lieu of these bearings or another means for moving along each shaft, the output holder partition 200 and the sweeper partition 210 may be fixed to respective shafts 202 and 212 and each shaft may be moved to move each partition.

In order to move the document cluster 180 onto the recirculation holder 150, it is also necessary to situate the gate 220 on the recirculation holder 150 in a retracted orientation. This may be accomplished in a number of ways known in the art including sliding the recirculation holder gate 220 to a level below the recirculation holder 150 or by rotating the recirculation holder gate 220 away from the path of the document cluster 180. For purposes of this discussion the recirculation holder gate 220 will be displaced to a level below the recirculation holder 150 using means for orienting 221. Slide mechanisms known in the art may be used for this. At this point, as shown in FIG. 18, the recirculation holder 150 is aligned with the output holder 172, and the output holder gate 205 and recirculation holder gate 215 are each be situated in a retracted orientation away from the path of the document cluster 180. While FIGS. 17-18 show the output holder gate 205 and the recirculation holder gate 220 retracted in separate steps, this may be done simultaneously.

Figure 19:
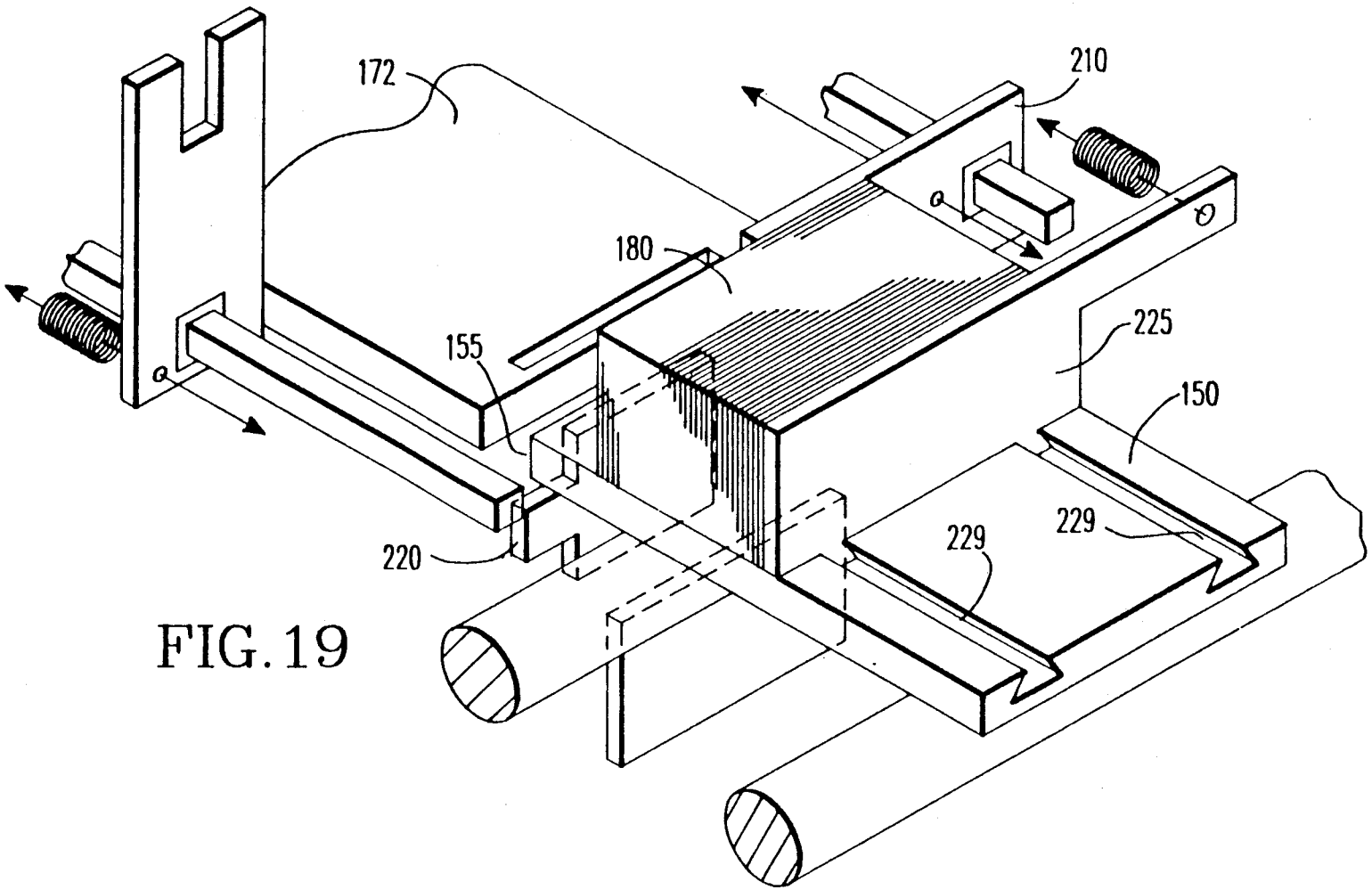

The sweeper partition 210 may now be advanced such that the document cluster 180 is transferred from the output holder 172 to the recirculation holder 150 as shown in FIG. 19. For clarity in FIG. 19 the output holder gate is not shown but note that it may be returned to an extended position at this time or anytime before a next cluster is moved on the output holder 172.

A recirculation holder partition 225 (FIG. 19) is movable along the length of the recirculation holder 150 and biased to resist movement away from the recirculation holder first end 155. Means for resiliently biasing 227 the recirculation holder partition 225 may comprise a spring or any of a variety of mechanisms known in the art. Furthermore, the partition 225 may be guided and may move along grooves 229 within the recirculation holder 150. Again, any of a variety of mechanisms known in the art to guide and permit the holder partition 225 to move along the recirculation holder 150 may be utilized.

Figure 20:
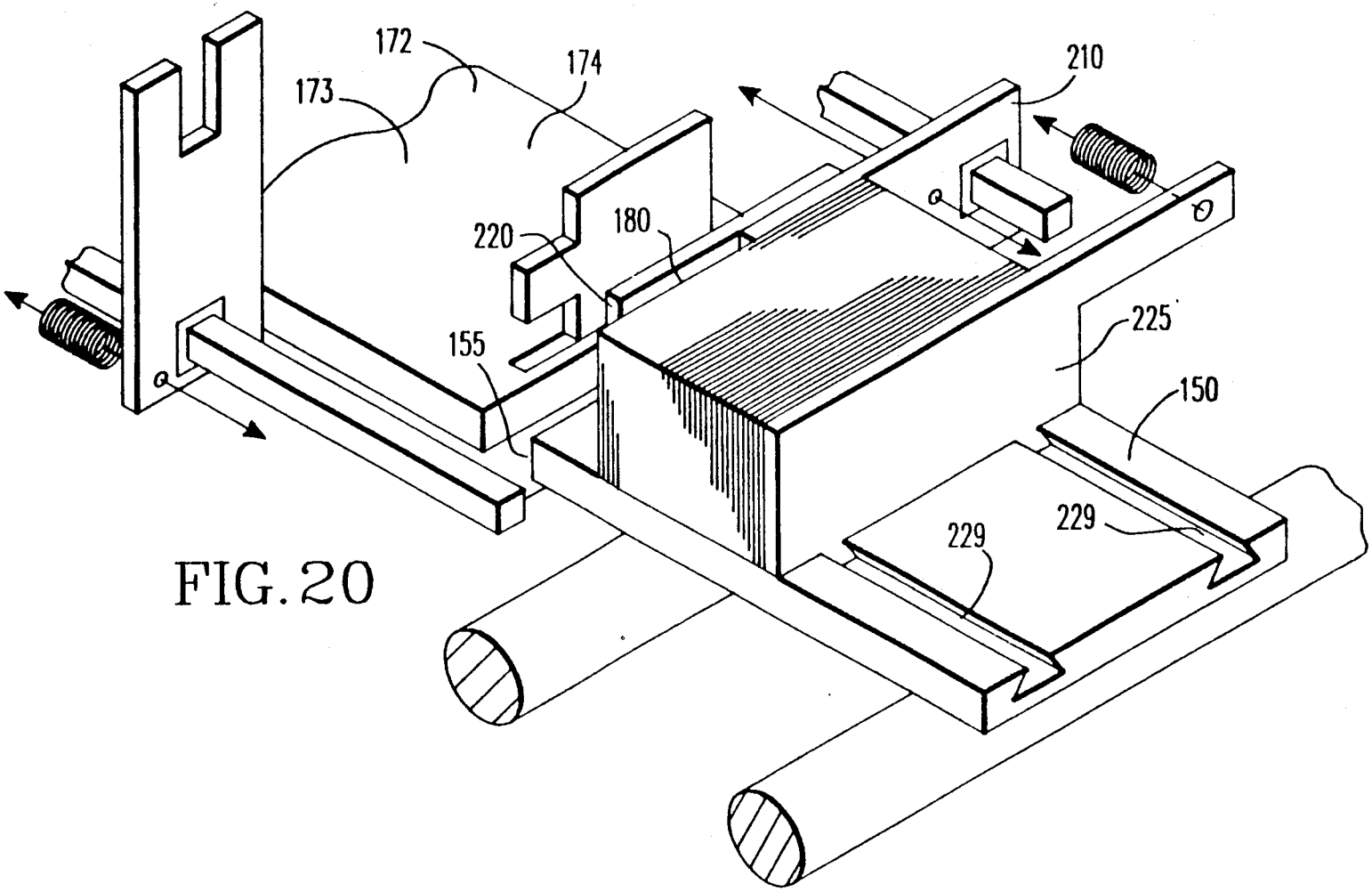

In this manner, as the sweeper partition 210 advances, the document cluster 180 is compressed against the recirculation holder partition 225 as shown in FIG. 19. Once the sweeper partition 210 is advanced past the position of the recirculation holder gate 220, the gate 220 is returned to its extended orientation as shown in FIG. 20. Simultaneously, or anytime before the next cluster is moved from the output holder 172 receiving area at the first end 173 to the transitional area at the second end 174, the output holder gate 205 may be returned to its extended orientation. At this point the sweeper partition 210 is compressed between the recirculation holder gate 220 and the document cluster 180.

Figure 21:
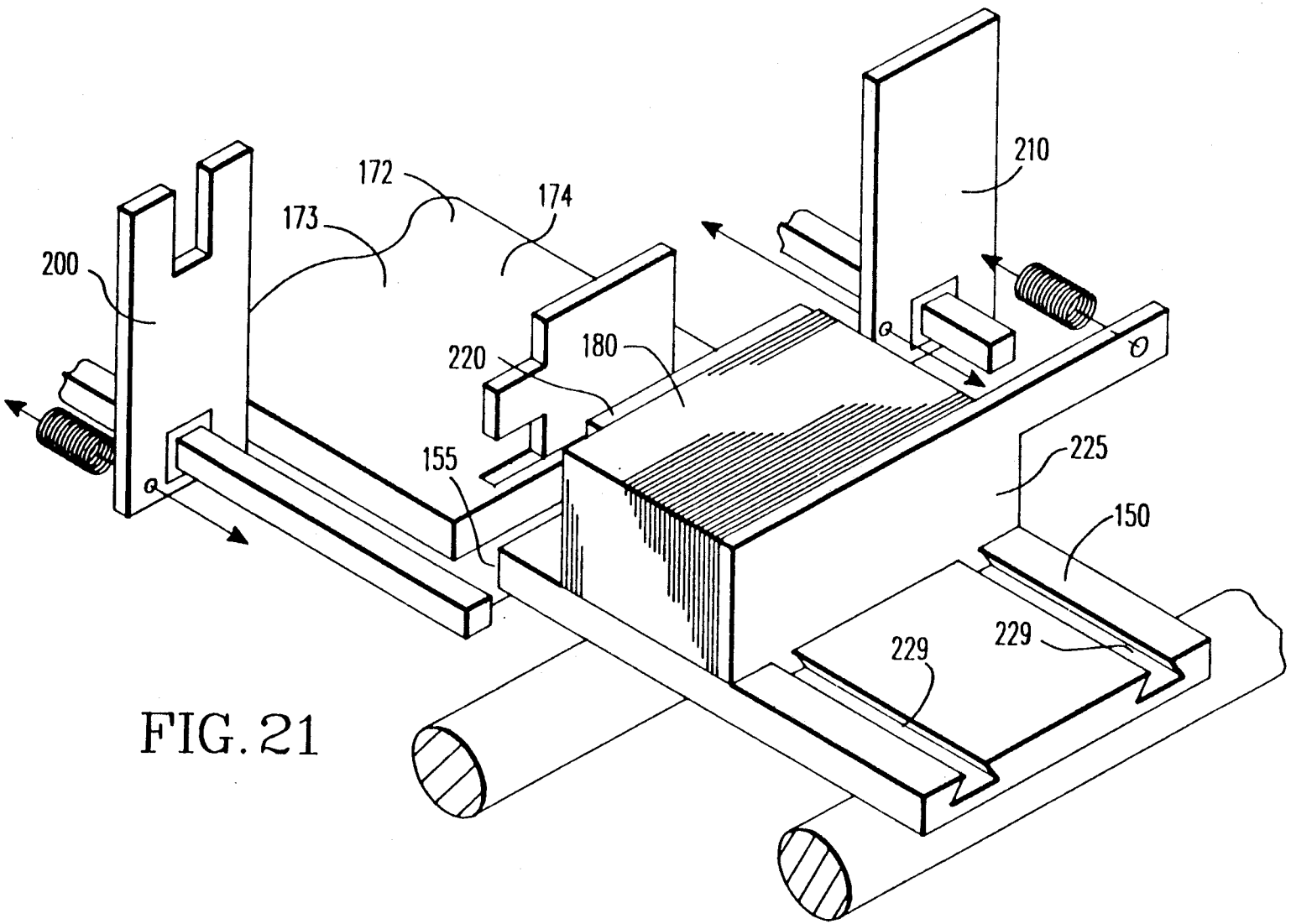
Figure 22:
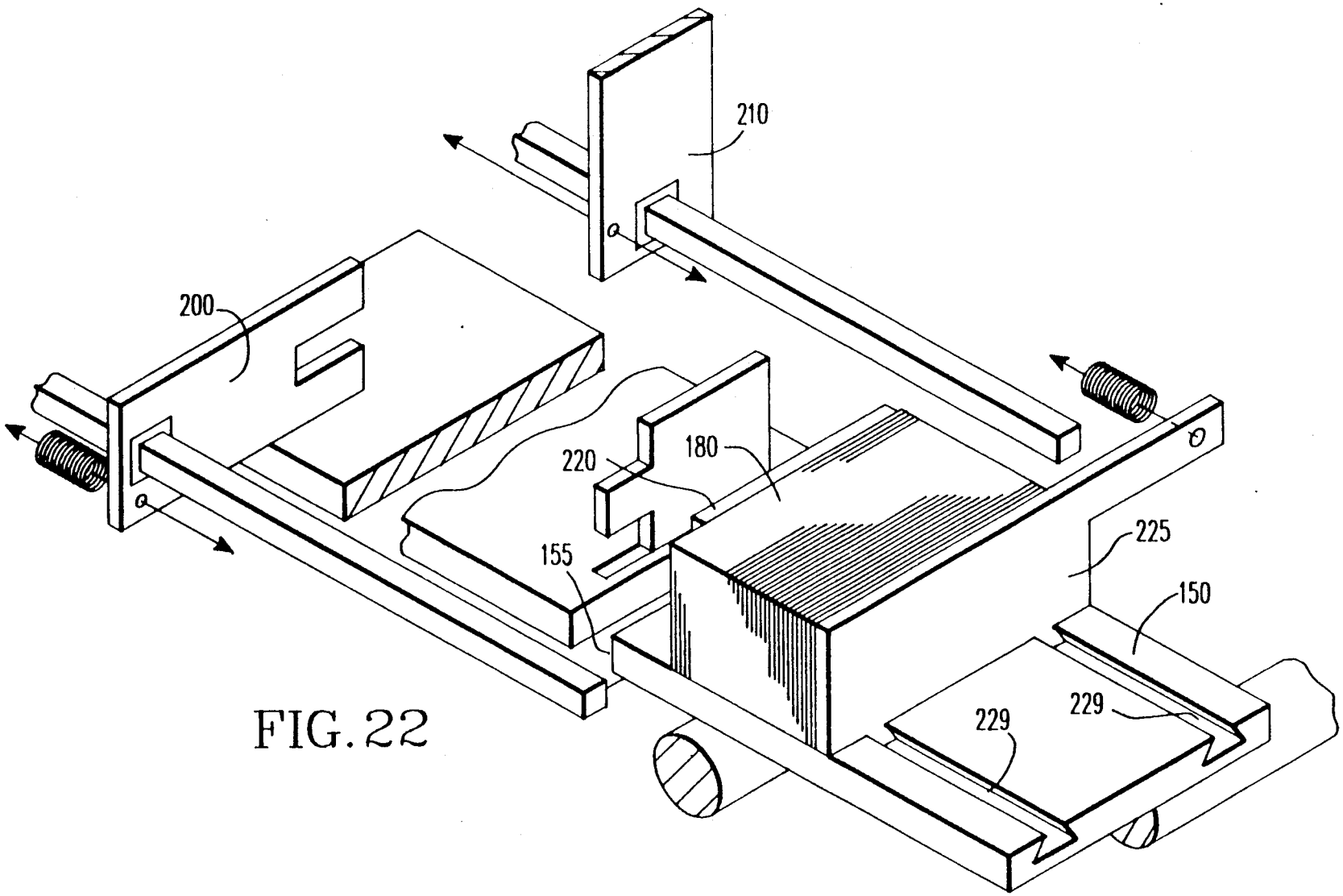

The sweeper partition 210 must now be moved such that it no longer contacts the document cluster 180. This is possible by situating the sweeper partition 210 in a retracted orientation as shown in FIG. 21. The document cluster 180 is now captured within the recirculation holder 150 between the recirculation holder gate 220 and the recirculation holder partition 225. The sweeper partition 210 may be returned to its original position as indicated in FIG. 22. The output holder partition 200, which is positioned in a retracted orientation (FIG. 21) may now be situated in an extended orientation such that it is positioned to receive documents from a next sorting pass (FIG. 22). The output holder partition 200 may be situated in the extended orientation shown in FIG. 22 at any time after the output holder partition 200 is away from the document cluster as shown in FIG. 16.

The recirculation holder 150 with its document cluster 180 may now be moved such that it is aligned with the induction subsystem 175 as shown in FIG. 15 and the document cluster 180 transferred to the input holder 179 of the induction subsystem 175. Through the repetition of the steps described in FIGS. 16 through 22, it can be seen that by automatically shuttling the recirculation cart 150 between output holders 172 containing document clusters 180 and the induction system 175, the entire collection of document clusters may be removed from the output holders and introduced into the induction subsystem 175 for subsequent sorting passes. This sequence may be repeated for as many sorting passes as necessary to achieve the desired level of sorting.

Figure 23:
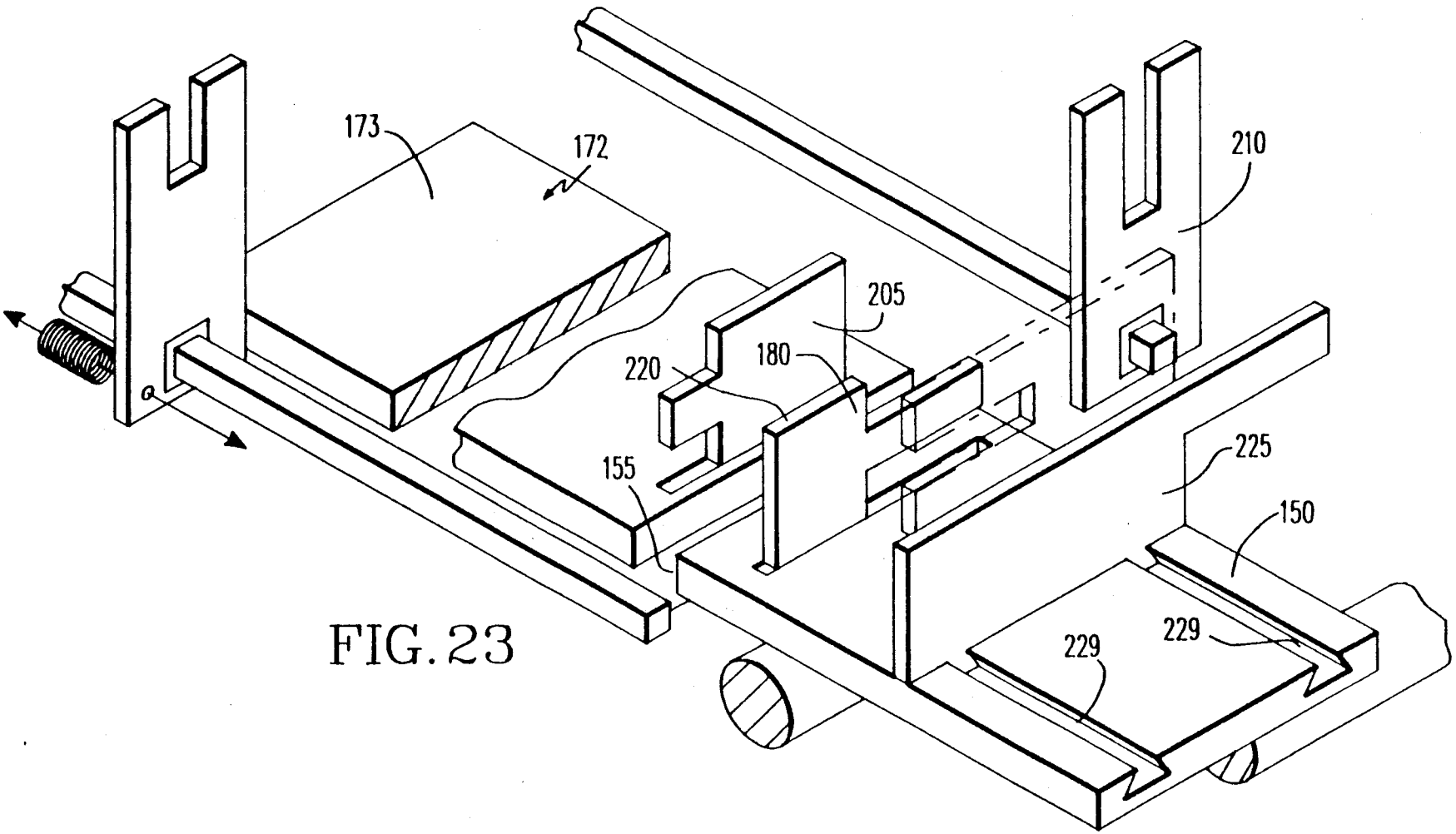
FIG. 23 illustrates an isometric drawing showing an alternate arrangement of the sweeper partition and the recirculation holder gate.

Note that in FIG. 20-21 the sweeper partition 210 in moving from the retracted to the extended orientation is forced to move against the document cluster 180 front face 181. This may be avoided by modifying the design of the sweeper partition 210 and the recirculation holder gate 220 such that the sweeper partition 210 may pass the gate 220 in an unobstructed manner. In this way, as shown in FIG. 23, with the output holder gate 205 situated in an extended orientation, the sweeper partition 210 shown in phantom in an extended orientation may be moved away from the document cluster 180 past the recirculation holder gate 220 and toward the first end 173 of the output holder 172, thereby transferring contact of the document cluster (not shown) to the gate 220 and releasing the sweeper partition 210 to return to the initial position along the output holder first end 173.

Since the output holder gate 205 will act as an obstruction to the sweeper partition 210 motion, then the sweeper partition 210 should be situated in a retracted orientation after the sweeper partition 210 passes the recirculation holder gate 220 but before contact can be made with the output holder gate 205. However, if the output holder gate 205 is situated in a retracted orientation, then the sweeper partition 210 may be moved past the gate 205 in an extended orientation. After the sweeper partition 210 is away from the gate 205, it may then be moved to the original retracted orientation at the input holder 172 first end 173.

It is possible to eliminate the output holder gate 205 (FIG. 23) completely and thereby reduce the number of parts in the document transfer device design.

Figure 24:
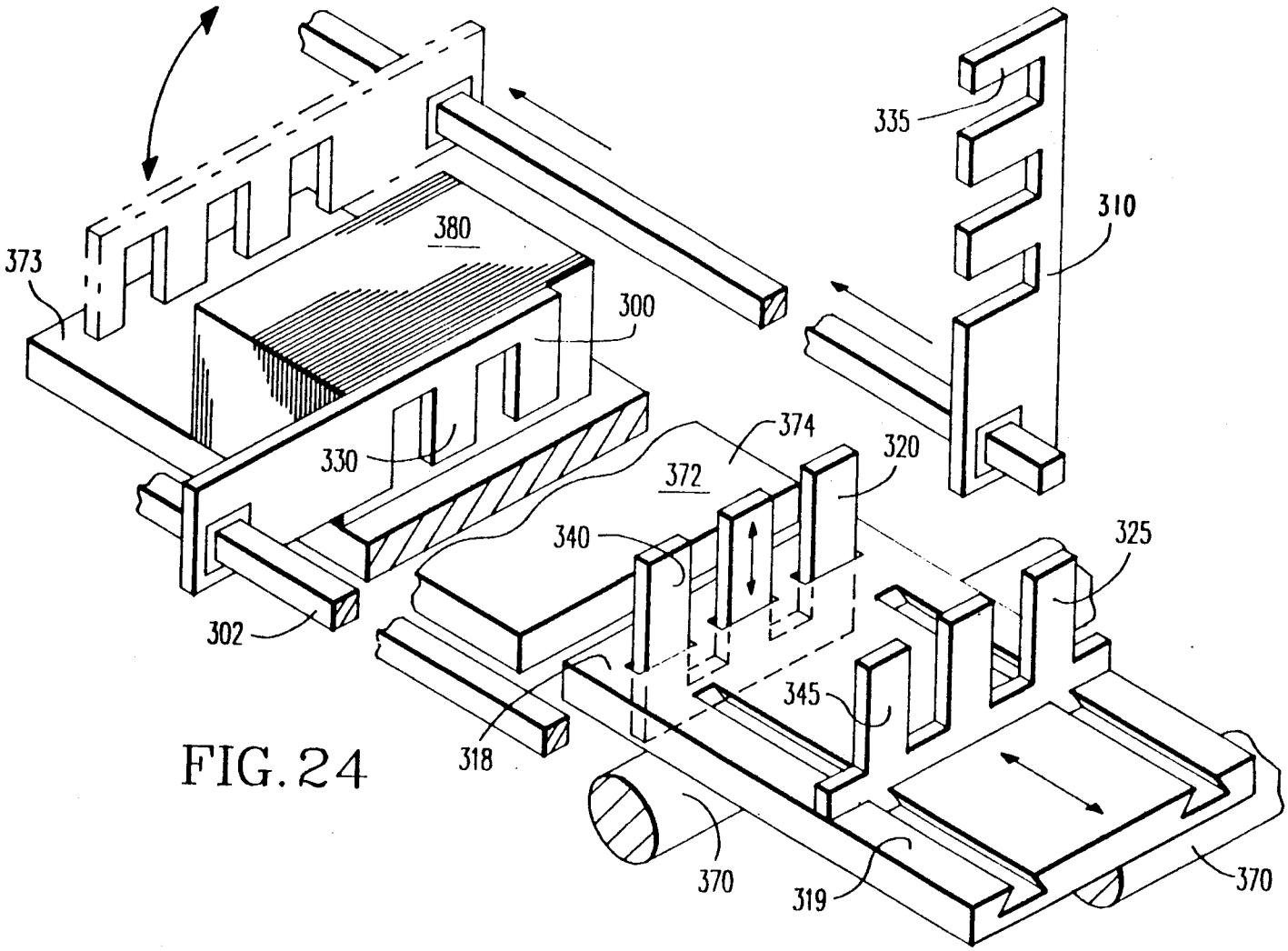
FIGS. 24-26 illustrate isometric drawings showing an alternative arrangement of the sweeper partition, the output holder and the recirculation holder gate.

FIG. 24 shows an output holder 372 with a first end 373 and a second end 374. A document cluster 380 rests on the output holder 372 urged at one end by an auger, or a similar device, to urge the cluster 380 toward the output folder second end 374. An output holder partition 300 is in contact with the document cluster 380. Just as the output holder partition 200 in FIGS. 16-23, the partition 300 is movable, capable of being oriented in a retracted or extended orientation and also biased toward the output holder first end 373.

Just as before, the sweeper partition 310 is movable between the output holder first end 373 and beyond the output holder second end 374 and is also capable of being oriented in an extended or a retracted orientation in a manner similar to that discussed for sweeper partition 210 in FIGS. 16-23.

Also just as before the recirculation holder gate 320 of the recirculation holder 317 is capable of being oriented in a retracted or extended orientation in a manner similar to that discussed for the recirculation holder gate 220 in FIGS. 16-23.

However, in FIG. 24 there is no longer an output holder gate (205 in FIG. 23). Because of this, the output holder partition 300 must be capable of movement beyond the second end 374 of the output holder 372 and onto the recirculation holder 317. To this end, the output holder shaft 302 may be extended to a distance onto the recirculation holder 317 up to the recirculation holder partition 325. In the alternative, as will be discussed, the output holder partition 200 may only be required to move up to the recirculation holder gate 320. As discussed for output holder partition 200, the partition 300 may be fixed to a shaft and the shaft may then be moved a greater distance to advance the partition 300 onto the recirculation holder 317.

In eliminating the output holder gate 205, a document cluster may no longer be held at the end of the output holder and must be moved directly on to the recirculation holder. Because of this, there must be a recirculation holder for each output holder. While only one output holder 372 and recirculation holder 317 are shown FIG. 24, it should be noted that for this arrangement there will be a plurality of recirculation holders 317 with one associated with each output holder 372. It may be noted that a plurality of recirculations holders may also be utilized in the design shown in FIGS. 16 through 23, however, the output holder gate 205 (FIG. 16) makes possible the use of only one recirculation holder 150 that may shuttle back and forth between output holders and the input holder.

Note that the output holder partition 300, the sweeper partition 310, the recirculation holder gate 320 and the recirculation holder partition 325 all have interdigitated fingers 330, 335, 340 and 345, respectively. The fingers are mateably configured such that the output holder partition 300 may pass in the extended position unobstructed past the recirculation holder partition 325. The fingers are also mateably configured such that the sweeper partition 310 may, in the extended position, pass unobstructed the recirculation holder gate 320 in the extended orientation. In this manner, with the sweeper partition 310 in the extended position (FIG. 24) and contacting the document cluster 380, the sweeper partition 310 may be advanced to advance the cluster 380 against the output holder partition 300, which is also in an extended orientation.

Figure 25:
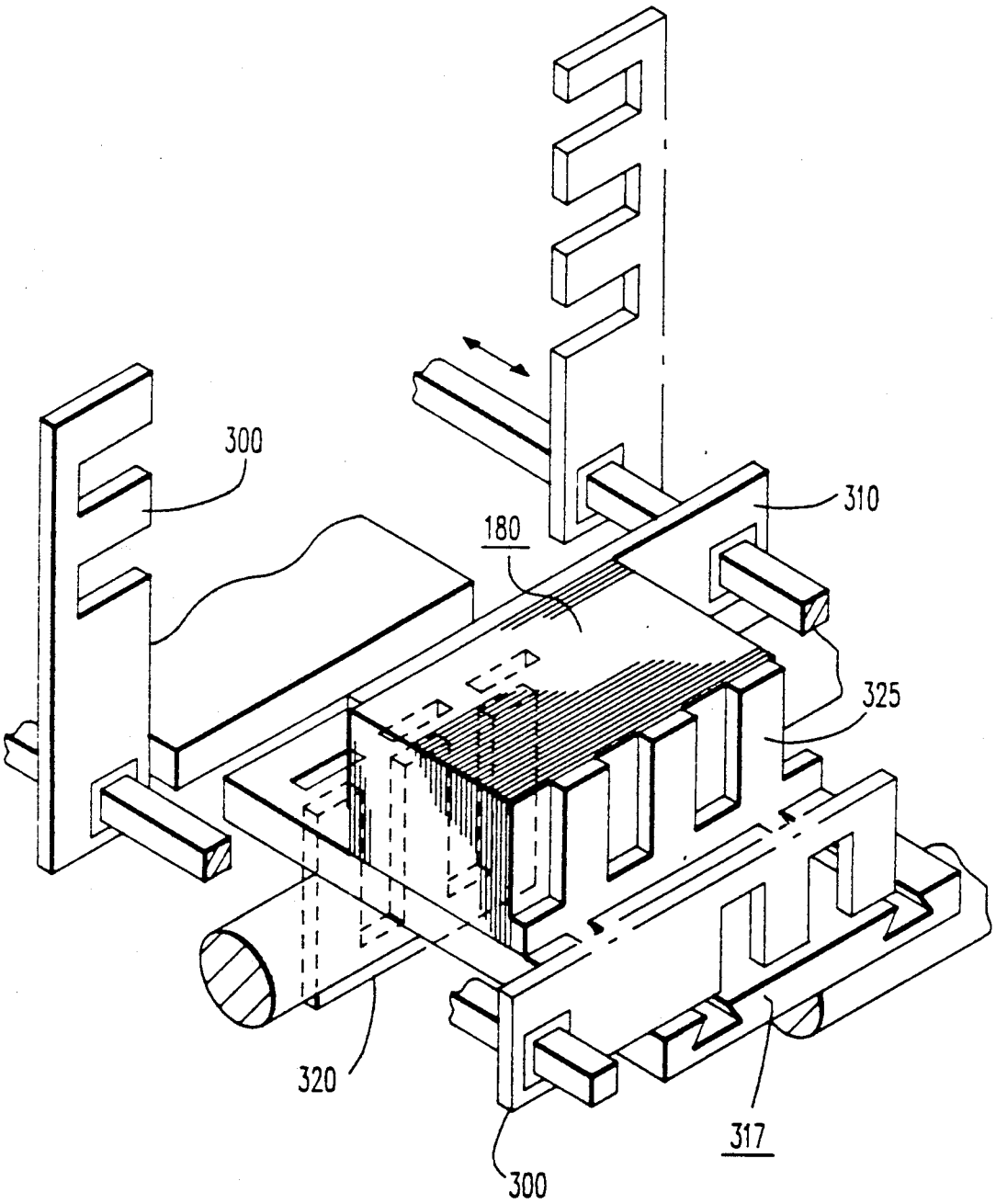

With the recirculation holder second end 374 aligned with the output holder first end 318, the sweeper partition 310 in the extended orientation (FIG. 24) may be advanced to move the document cluster 380 and the output holder partition 310, which is also in the extended orientation, toward the output holder second end 374. Before the document cluster 380 reaches the recirculation holder gate 320, the gate must be situated in the retracted orientation to permit the cluster 380 to move onto the recirculation holder 317 as shown in FIG. 25. Once the sweeper partition 310 has advanced, the cluster 380 past the recirculation holder gate 320 (in the retracted orientation), the gate 320 may then be situated in an extended orientation as shown in FIG. 26.

Figure 26:
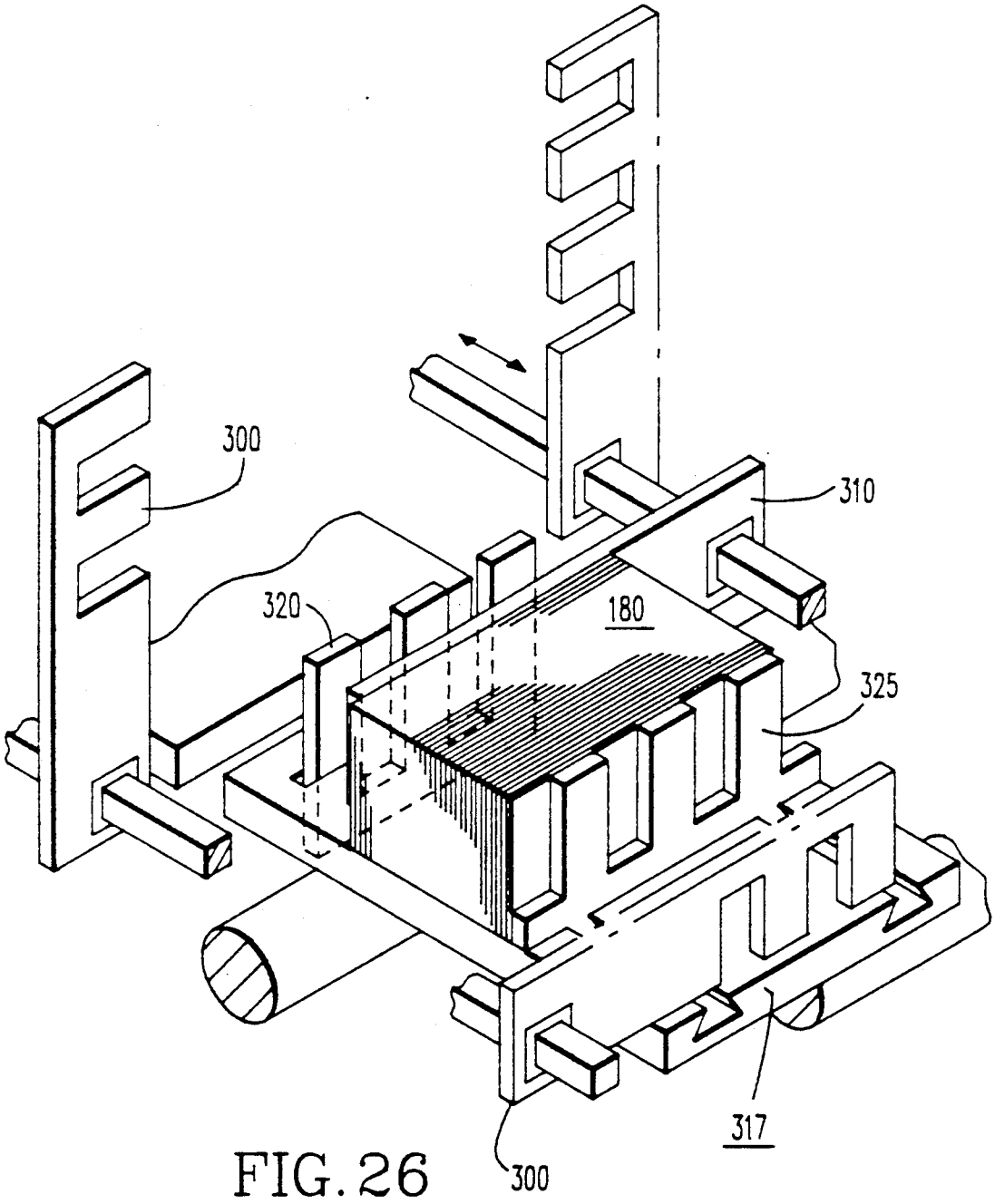

FIG. 26 shows the sweeper partition 310 between the document cluster 380 and the recirculation holder gate 320. Since the recirculation holder gate 320 and the sweeper partition 310 are mateably configured, the sweeper partition 310 may be moved in the extended orientation away from the cluster 380 and past the recirculation holder gate 320 such that the cluster 380 contacts the gate 320 and the sweeper partition 310 no longer contacts the cluster 380. In this manner, the sweeper partition 310 is free to return to the initial position at the output holder first end 373.

In the process of advancing the cluster 380 and the recirculation holder 317, the output holder partition 300 is also advanced onto the recirculation holder 317. When the partition 300 is advanced to the recirculation holder partition 225, since the interdigitated fingers on the partition 225 and the output holder partition 300 are mateably configured, the output holder partition 300 passes the recirculation holder partition 325 unobstructed. In this manner, the cluster 380 contacts the recirculation holder partition 325 and the output holder partition 300 is free to return to the original position as shown in FIG. 26. The partition 300 may then be situated in an extended orientation ready to accept a next document cluster (not shown).

At this point it should be appreciated that while interdigitated fingers are utilized so that the output holder partition 300 and the sweeper partition 310 may pass unobstructed by the output holder gate 320, and the output holder partition 300 may pass unobstructed by the recirculation tray partition 325, there may also be another embodiment. If the parts described above were not mateably configured, rather than mateably pass one another, each part could be oriented away from the other. In this manner the output holder partition 300 when it approaches the recirculation holder gate 320 could be oriented in the retracted position. A document cluster would then directly contact the recirculation holder gate 320. This gate 320 could then be retracted leaving the document cluster against the recirculations holder partition 325. In orienting the partition 300, the partition 300 slides against the gate 320 and the document cluster. This same movement could be made by the sweeper partition 310. Instead of advancing past the retracted recirculation holder gate 320 and then moving back through the extended gate 320, the sweeper partition 310 may be oriented in a retracted position while it is between the recirculation holder gate 320 and the document cluster 380. In orienting the sweeper partition 310 in the retracted position, it slides from between the document cluster and the recirculation holder gate 320.

Figure 27:
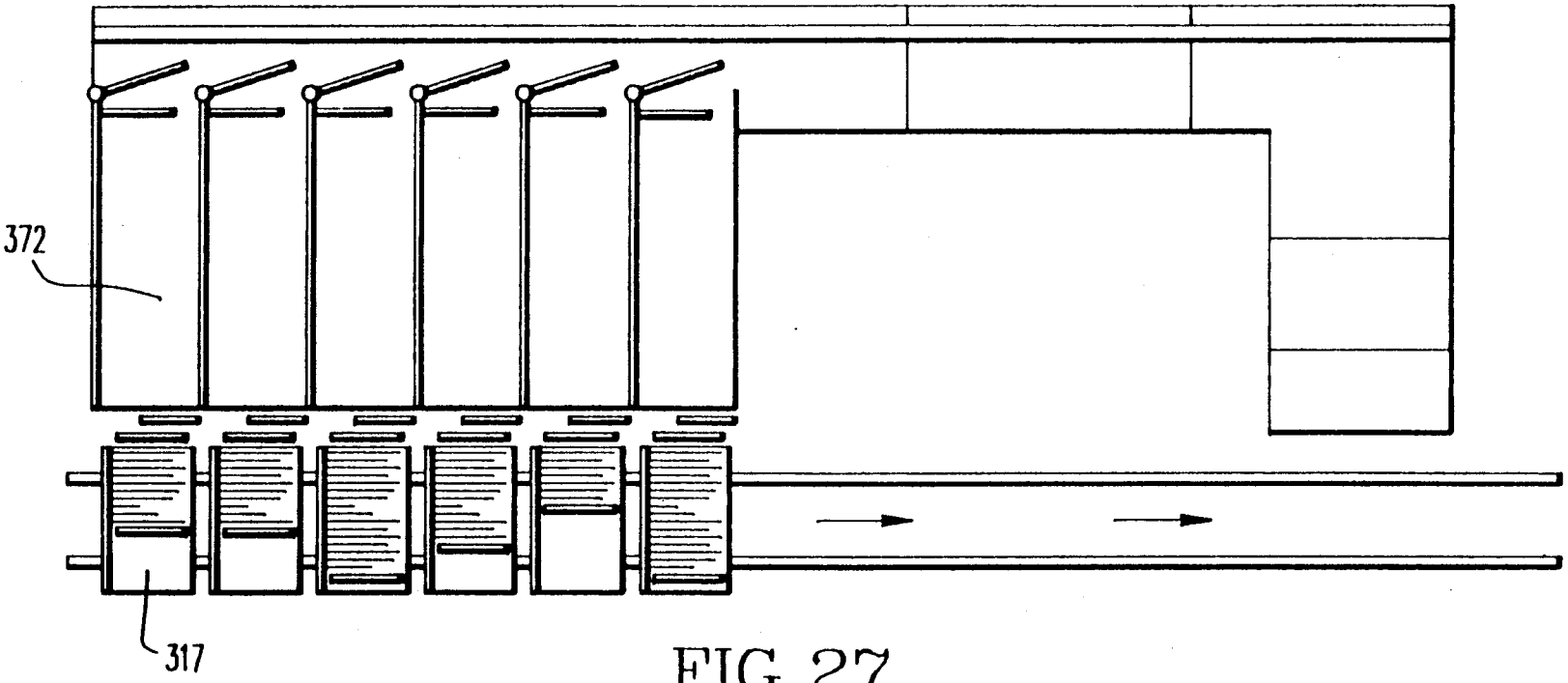
FIG. 27 illustrates a schematic plan view of a multiple pass document sorting device utilizing multiple recirculation holders to transfer documents from the output holders to the induction subsystem of the sorting device.

With the use of one recirculation holder 317 for each output holder 372, all of the document clusters in the output holders are transferred to the recirculation holders and then each recirculation holder is indexed to the input holder where the associated cluster is transferred to the input holder. After all of the recirculations holders are indexed with the input holder and the respective document cluster transferred, then the recirculation holders are returned to their original positions aligned with the output holders. A simplified schematic of this arrangement is shown in FIG. 27.

Although this invention has been described with reference to a specific embodiment thereof, numerous modifications are possible without departing from the invention, and it is desirable to cover all modifications falling within the spirit and the scope of this invention.

What we claim is:

1. A document transfer system for moving a cluster with a front and a back face of accumulated stacked documents from a receiving area at the first end of an output holder having first and second ends to the second end of the output holder and subsequently accepting a next cluster of stacked documents into the receiving area for transfer to the second end of the output holder, said system comprising:

a) an output holder partition;

b) means for permitting movement of the output holder partition between the first and second ends of the output holder;

c) means for orienting the output holder partition in an extended orientation to contact the back face of the cluster and in a retracted orientation to avoid contact with the cluster with the output holder partition having an initial extended orientation at the output holder first end;

d) a sweeper partition;

e) means for moving the sweeper partition between the first end of the output holder to at least the second end of the output holder;

f) means for orienting the sweeper partition in an extended orientation to contact the front face of the cluster and in a retracted orientation to avoid contacting the cluster, with the sweeper partition having an initial retracted orientation at the output holder first end and;

g) an output holder gate at the second end of the output holder to stop the document cluster when the cluster is moved to the output holder second end, whereby the sweeper partition, when a cluster has accumulated within the output holder first end, is oriented in an extended orientation and advanced to advance an accumulated document cluster in the output holder receiving area against the output holder partition which is in an extended orientation to the second end of the output holder, the output holder partition then is retracted and returned to the initial extended position, and a next cluster may be provided to the receiving area of the output holder; wherein the output holder partition and the output holder gate are mateably configured to permit the output holder partition in an extended orientation to pass the output holder gate unobstructed such that when the document cluster is advanced to the second end of the output holder by the sweeper, the output holder partition passes the output holder gate, the document cluster becomes captured between the sweeper partition and the output holder gate and the output holder partition passes the output holder gate, situates in the retracted orientation and returns to the extended orientation at the initial position.

2. The document transfer system as described in claim 1 wherein the output holder partition and the output holder gate are mateably configured through the partition and gate each having mateably configured interdigitated fingers.

3. The document transfer system as described in claim 1 further comprising means for biasing the output holder partition toward the output holder first end.

4. The document transfer system as described in claim 1, further comprising means for resiliently biasing the output holder partition toward the output holder first end.

5. The document transfer system as described in claim 1 wherein the means for permitting movement of the output holder partition comprises a shaft extending from the output holder first end to at least the output holder second end and a bearing set within the output holder partition mated with the shaft and wherein the means for moving the sweeper partition comprises a shaft extending from the output holder first end up to the output holder second end, a bearing set within the sweeper partition mated with the shaft and means for pulling the sweeper partition along the shaft.

6. The document transfer system as described in claim 5 wherein the output holder shaft is rectangular and the means for orienting the output holder partition is comprised of a driver and a coupling from the driver to the shaft to rotate the shaft and wherein the sweeper shaft is rectangular and the means for orienting the sweeper partition is comprised of a driver and a coupling from the driver to the shaft to rotate the sweeper partition shaft.

7. The document transfer system as described in claim 1 wherein the output holder partition and the output holder gate are mateably configured through the partition and gate each having mateably configured interdigitated fingers.

8. A document transfer system for moving a cluster with a front and a back face of accumulated stacked documents from a receiving area at the first end of an output holder having first and second ends to the second end of the output holder and subsequently accepting a next cluster of stacked documents into the receiving area for transfer to the second end of the output holder, said system comprising:

a) an output holder partition, means for biasing the output holder partition toward the output holder first end;

b) means for permitting movement of the output holder partition between the first and second ends of the output holder comprising a rectangular shaft extending from the output holder first end to at least the output holder second end and a bearing set within the output holder partition mated with the shaft;

c) means for orienting the output holder partition in an extended orientation to contact the back face of the cluster and in a retracted orientation to avoid contact with the cluster with the output holder partition having an initial extended orientation at the output holder first end comprising a driver and a coupling from the driver to the shaft to rotate the shaft;

d) a sweeper partition;

e) means for moving the sweeper partition between the first end of the output holder to at least the second end of the output holder comprising a rectangular shaft extending from the output holder first end up to the output holder second end, a bearing set within the sweeper partition mated with the shaft and means for pulling the sweeper partition along the shaft;

f) means for orienting the sweeper partition in an extended orientation to contact the front face of the cluster and in a retracted orientation to avoid contacting the cluster, with the sweeper partition having an initial retracted orientation at the output holder first end comprising a driver and a coupling from the driver to the shaft to rotate the sweeper partition shaft;

g) an output holder gate at the second end of the output holder to stop the document cluster when the cluster is moved to the output holder second end, said gate mateably configured with the output holder partition to permit the output holder partition in an extended orientation to pass the output holder gate unobstructed, such that the sweeper partition, when a cluster has accumulated within the output holder first end, is oriented in an extended orientation and advanced to advance an accumulated document cluster in the output holder receiving area against the extended output holder partition to the second end of the output holder, the output holder partition passes the output holder gate and then is retracted and returned to the initial extended position for processing a next cluster provided to the receiving area of the output holder.

9. A document transfer system for moving a cluster with a front and a back face of accumulated stacked documents from a receiving area at the first end of an output holder having first and second ends to a recirculation holder and subsequently accepting a next cluster of stacked documents into the receiving area for transfer to the recirculation holder, said system comprising:

a) an output holder partition;

b) means for permitting movement of the output holder partition between the first and second ends of the output holder;

c) means for orienting the output holder partition in an extended orientation to contact the back face of the cluster and in a retracted orientation to avoid contact with the cluster with the output holder partition having an initial extended orientation at the output holder first end;

d) a sweeper partition;

e) means for moving the sweeper partition between the first end of the output holder to at least the second end of the output holder;

f) means for orienting the sweeper partition in an extended orientation to contact the front face of the cluster and in a retracted orientation to avoid contacting the cluster with the sweeper partition having an initial retracted orientation at the output holder first end and;

g) an output holder gate at the second end of the output holder to stop the document cluster when the cluster is moved to the output holder second end;

h) means for orienting the output holder gate in an extended orientation to contact the front face of the cluster and in a retracted orientation to avoid contact with the cluster with the output holder gate having an initial extended orientation and;

i) a recirculation holder having a first and second end with the first end aligned and generally abutting the second end of the output holder; wherein the recirculation holder is further comprised of a recirculation holder gate at the first end of the recirculation holder and a recirculation holder partition movable between the first and second ends of the recirculation holder with an initial partition position at the recirculation holder first end.

10. The document transfer system as described in claim 9 further comprising means for orienting the recirculation holder gate in an extended orientation to contact the cluster and in a retracted orientation to avoid contact with the cluster with the output holder gate having an initial extended orientation.

11. The document transfer system as described in claim 10 wherein the output holder gate and the output holder partition are mateably configured to permit the output holder partition in an extended orientation to pass the extended output holder gate unobstructed.

12. The document transfer system as described in claim 11 wherein the sweeper partition and the recirculation holder gate are mateably configured to permit the extended sweeper partition to pass the extended recirculation holder gate unobstructed.

13. The document transfer system as described in claim 12 wherein the sweeper partition and the recirculation holder gate are mateably configured through the partition and gate each having mateably configured interdigitated fingers.

14. The document transfer system as described in claim 10, further comprising means for biasing the output holder partition toward the output holder first end.

15. The document transfer system as described in claim 10, further comprising means for resiliently biasing the output holder partition toward the output holder first end.

16. The document transfer system as described in claim 14, further comprising means for biasing the recirculation holder partition toward the recirculation holder first end.

17. The document transfer system as described in claim 14, further comprising means for resiliently biasing the recirculation holder partition toward the recirculation holder first end.

18. The document transfer system as described in claim 10 wherein i) the means for permitting movement of the output holder partition comprises a shaft extending from the output holder first end to beyond the output holder second end and a bearing set within the output holder partition mated with the shaft and ii) the means for moving the sweeper partition comprises a shaft extending from the output holder first end to beyond the output holder second end, a bearing set within the sweeper partition mated with the shaft and means for pulling the sweeper partition along the shaft.

19. The document transfer system as described in claim 18 wherein i) the output holder shaft is rectangular and the means for orienting the output holder partition is comprised of a driver and a coupling from the driver to the shaft to rotate the shaft, ii) the sweeper shaft is rectangular and the means for orienting the sweeper partition is comprised of a driver and a coupling from the driver to the shaft to rotate the sweeper partition shaft and iii) the means for orienting the recirculation holder gate is a mechanism capable of vertically displacing the recirculation holder gate from an extended orientation above the recirculation holder to a retracted orientation below the recirculation holder.

20. A document transfer system for moving a cluster with a front and a back face of accumulated stacked documents from a receiving area at the first end of an output holder having first and second ends to a recirculation holder and subsequently accepting a next cluster of stacked documents into the receiving area for transfer to the recirculation holder, said system comprising:

a) an output holder partition, means for biasing the output holder partition toward the output holder first end;

b) means for permitting movement of the output holder partition between the first and second ends of the output holder comprising a rectangular shaft extending from the output holder first end to beyond the output holder second end and a bearing set within the output holder partition mated with the shaft;

c) means for orienting the output holder partition in an extended orientation to contact the back face of the cluster and in a retracted orientation to avoid contact with the cluster with the output holder partition having an initial extended orientation at the output holder first end comprising a driver and a coupling from the driver to the shaft to rotate the shaft;

d) a sweeper partition;

e) means for moving the sweeper partition between the first end of the output holder to at least the second end of the output holder comprising a rectangular shaft extending from the output holder first end to beyond the output holder second end, a bearing set within the sweeper partition mated with the shaft and means for pulling the sweeper partition along the shaft;

f) means for orienting the sweeper partition in an extended orientation to contact the front face of the cluster and in a retracted orientation to avoid contact with the cluster with the sweeper partition having an initial retracted orientation at the output holder first end comprising a driver and a coupling from the driver to the shaft to rotate the sweeper partition shaft;

g) an output holder gate at the second end of the output holder to stop the document cluster when the cluster is moved to the output holder second end, the output holder gate being mateably configured with the output holder partition to permit the extended output holder partition to pass the extended output holder gate unobstructed;

h) means for orienting the output holder gate in an extended orientation to contact the front face of the cluster and in a retracted orientation to avoid contact with the cluster with the output holder gate having an initial extended orientation comprising a mechanism capable of vertically displacing the recirculation holder gate from an extended orientation above the recirculation holder to a retracted orientation below the recirculation holder and;

i) a recirculation holder having a first and second end with the first end aligned and generally abutting the second end of the output holder, the recirculation holder further comprising a recirculation holder gate at the first end of the recirculation holder and a recirculation holder partition movable between the first and second ends of the recirculation holder with an initial partition position at the recirculation holder first end and the recirculation gate being mateably configured with the sweeper partition to permit the extended sweeper partition to pass the extended recirculation holder gate unobstructed.

21. A document transfer system for moving a cluster of stacked documents, each cluster having a front and a back face, from a receiving area at the first end of an output holder having first and second ends to a recirculation holder and subsequently accepting a next cluster of stacked documents into the receiving area for transfer to the input holder, said system comprising:

a) an output holder partition;

b) means for permitting movement of the output holder partition between the first and second ends of the output holder;

c) means for orienting the output holder partition in an extended orientation to contact the back face of the cluster and in a retracted orientation to avoid contact with the cluster, the output holder partition having an initial position at the output holder first end in an extended orientation d) a sweeper partition;

e) means for moving the sweeper partition between the first end of the output holder to at least the second end of the output holder;

f) means for orienting the sweeper partition in an extended orientation to contact the front face of the cluster and in a retracted orientation to avoid contact with the cluster, the sweeper partition having an initial position at the output holder first end in a retracted orientation;

g) a recirculation holder having a first and second end with the first end aligned and generally abutting the second end of the output holder wherein the recirculation holder is further comprised of a recirculation holder gate at the first end of the recirculation holder and a recirculation holder partition movable between the first and second ends of the recirculation holder with an initial partition position at the recirculation holder first end.

22. The document transfer system as described in claim 21 further comprising means for orienting the recirculation holder gate in an extended orientation to contact the cluster and in a retracted orientation to avoid contact with the cluster with the output holder gate having an initial extended orientation.

23. The document transfer system as described in claim 22 wherein the output holder partition and the recirculation holder partition are mateably configured to permit the output holder partition in an extended orientation to pass the recirculation holder partition unobstructed.

24. The document transfer system as described in claim 23 wherein the output holder partition and the recirculation holder partition are mateably configured through the partitions each having mateably configured interdigitated fingers.

25. The document transfer system as described in claim 23 wherein the sweeper partition and the recirculation holder gate are mateably configured to permit the sweeper partition in an extended orientation to pass the extended recirculation holder gate unobstructed.

26. The document transfer system as described in claim 25 wherein the sweeper partition and the recirculation holder gate are mateably configured through the partition and gate each having mateably configured interdigitated fingers.

27. The document transfer system as described in claim 22 wherein i) the sweeper partition and the output holder partition are both mateably with the recirculation holder gate to permit the sweeper partition and the output holder partition in extended orientations to pass the extended recirculation holder gate unobstructed and ii) the output holder partition is also mateably configured with the recirculation holder partition to permit the output holder partition in an extended orientation to pass the recirculation holder partition unobstructed.

28. The document transfer system as described in claim 27 wherein the mateable configurations of the partitions and gates utilize interdigitated fingers in the partitions and gates.

29. The document transfer system as described in claim 22, further comprising means for biasing the output holder partition toward the output holder first end and means for biasing the recirculation holder partition toward the recirculation holder first end.

30. The document transfer system as described in claim 22, further comprising means for resiliently biasing the output holder partition toward the output holder first end and means for resiliently biasing the recirculation holder partition toward the recirculation holder first end.

31. The document transfer system as described in claim 22 wherein i) the means for permitting movement of the output holder partition comprises a rectangular shaft extending from the output holder first end to beyond the output holder second end and a bearing set within the output holder partition mated with the shaft;

ii) the means for orienting the output holder partition is comprised of a driver and a coupling from the driver to the shaft to rotate the shaft;

iii) the means for moving the sweeper partition comprises a rectangular shaft extending from the output holder first end to beyond the output holder second end, a bearing set within the sweeper partition mated with the shaft and means for pulling the sweeper partition along the shaft;

iv) the means for orienting the sweeper partition is comprised of a driver and a coupling from the driver to the shaft to rotate the sweeper partition shaft and;

v) the means for orienting the recirculation holder gate is a mechanism capable of vertically displacing the recirculation holder gate from an extended orientation above the recirculation holder to a retracted orientation below the recirculation holder.

32. A document transfer system for moving a cluster of stacked documents, each cluster having a front and a back face, from a receiving area at the first end of an output holder having first and second ends to a recirculation holder and subsequently accepting a next cluster of stacked documents into the receiving area for transfer to the input holder, said system comprising:

a) an output holder partition, means for biasing the output holder partition toward the output holder first end;

b) means for permitting movement of the output holder partition between the first and second ends of the output holder comprising a rectangular shaft extending from the output holder first end to beyond the output holder second end and a bearing set within the output holder partition mated with the shaft;

c) means for orienting the output holder partition in an extended orientation to contact the back face of the cluster and in a retracted orientation to avoid contact with the cluster, the output holder partition having an initial position at the output holder first end in an extended orientation comprising a driver and a coupling from the driver to the shaft to rotate the shaft;

d) a sweeper partition;

e) means for moving the sweeper partition between the first end of the output holder to at least the second end of the output holder comprising a rectangular shaft extending from the output holder first end to beyond the output holder second end, a bearing set within the sweeper partition mated with the shaft and means for pulling the sweeper partition along the shaft;

f) means for orienting the sweeper partition in an extended orientation to contact the front face of the cluster and in a retracted orientation to avoid contact with the cluster, the sweeper partition having an initial position at the output holder first end in a retracted orientation comprising a driver and a coupling from the driver to the shaft to rotate the sweeper partition shaft and;

g) a recirculation holder having a first and second end with the first end aligned and generally abutting the second end of the output holder wherein the recirculation holder is further comprised of a recirculation holder gate at the first end of the recirculation holder and a recirculation holder partition movable between the first and second ends of the recirculation holder, means for biasing the recirculation holder partition toward the holder first end with the partition having an initial partition position at the recirculation holder first end and with the recirculation holder partition and the output holder partition being mateably configured to permit the extended output partition to pass the recirculation holder partition unobstructed and furthermore with the recirculation holder gate and the sweeper partition being mateably configured to permit the extended sweeper partition to pass the extended recirculation holder gate unobstructed;

h) means for orienting the recirculation holder gate in an extended orientation to contact the cluster and in a retracted orientation to avoid contact with the cluster with the output holder gate having an initial extended orientation comprising a mechanism capable of vertically displacing the recirculation holder gate from an extended orientation above the recirculation holder to a retracted orientation below the recirculation holder.

* * * * *